US008910478B2

(12) United States Patent
Cheng et al.

(10) Patent No.: US 8,910,478 B2
(45) Date of Patent: Dec. 16, 2014

(54) MODEL-FREE ADAPTIVE CONTROL OF SUPERCRITICAL CIRCULATING FLUIDIZED-BED BOILERS

(71) Applicant: General Cybernation Group, Inc., Rancho Cordova, CA (US)

(72) Inventors: George Shu-Xing Cheng, Folsom, CA (US); Steven L. Mulkey, Cameron Park, CA (US)

(73) Assignee: General Cybernation Group, Inc., Rancho Cordova, CA (US)

( * ) Notice: Subject to any disclaimer, the term of this patent is extended or adjusted under 35 U.S.C. 154(b) by 162 days.

(21) Appl. No.: 13/739,939

(22) Filed: Jan. 11, 2013

(65) Prior Publication Data

US 2013/0180244 A1 Jul. 18, 2013

Related U.S. Application Data

(63) Continuation of application No. 61/586,411, filed on Jan. 13, 2012.

(51) Int. Cl.

| | |
|---|---|
| ***F01K 11/00*** | (2006.01) |
| ***F01K 7/22*** | (2006.01) |
| ***F22B 37/42*** | (2006.01) |

(52) U.S. Cl.

USPC ..... 60/664; 60/667; 60/679; 700/45; 122/448.1

(58) Field of Classification Search

USPC ..... 60/660, 662, 663, 664, 667, 670, 677, 60/679; 700/45, 46; 122/448.1, 448.3

See application file for complete search history.

(56) References Cited

U.S. PATENT DOCUMENTS

| | | | | |
|---|---|---|---|---|
| 2,315,527 | A * | 4/1943 | Junkins et al. | 122/448.3 |
| 3,138,000 | A * | 6/1964 | Vollmer, Jr. | 60/39.182 |
| 3,625,186 | A * | 12/1971 | Herbst | 122/57 |
| 5,027,751 | A * | 7/1991 | Archer et al. | 122/449 |
| 5,038,568 | A * | 8/1991 | Gounder et al. | 60/679 |
| 2012/0259437 | A1 * | 10/2012 | Cheng et al. | 700/45 |

* cited by examiner

*Primary Examiner* — Hoang Nguyen

(74) *Attorney, Agent, or Firm* — Donald E. Stout; Stout, Uxa & Buyan, LLP

(57) ABSTRACT

A novel 3-Input-3-Output (3×3) Fuel-Air Ratio Model-Free Adaptive (MFA) controller is introduced, which can effectively control key process variables including Bed Temperature, Excess O2, and Furnace Negative Pressure of combustion processes of advanced boilers. A novel 7-input-7-output (7×7) MFA control system is also described for controlling a combined 3-Input-3-Output (3×3) process of Boiler-Turbine-Generator (BTG) units and a 5×5 CFB combustion process of advanced boilers. Those boilers include Circulating Fluidized-Bed (CFB) Boilers and Once-Through Supercritical Circulating Fluidized-Bed (OTSC CFB) Boilers.

16 Claims, 14 Drawing Sheets

MODEL-FREE ADAPTIVE CONTROL OF SUPERCRITICAL CIRCULATING FLUIDIZED-BED BOILERS

This application claims priority to U.S. Provisional Application No. 61/586,411 filed on Jan. 13, 2012, which is herein incorporated by reference.

This invention was made with government support under SBIR grant DE-FG02-06ER84599 awarded by the U.S. Department of Energy. The government has certain rights to the invention.

INVENTION

The subject of this patent relates to automatic control of power plants, and more particularly to a method and apparatus for intelligently controlling Circulating Fluidized-Bed (CFB) Boilers and Once-Through Supercritical Circulating Fluidized-Bed (OTSC CFB) Boilers.

For the U.S. to reach its future energy objectives, visions to build ultra-clean and highly efficient energy plants of the future have to be realized. In parallel with the development of sensors, more robust and flexible process control technologies must be developed to build an intelligent control system that can yield a fully automated operation and be adaptive to changing process needs and fuel availability. It must be safe, reliable, and easy to install, maintain, and operate. The intelligent control system is aimed to control conventional boilers as well as advanced boilers including Once-Through Supercritical Boilers, Circulating Fluidized-Bed (CFB) Boilers, and Supercritical CFB Boilers in future energy plants that can deliver maximum-energy-efficiency, near-zero-emissions, fuel-flexibility, and multi-products.

First introduced in 1997, the Model-Free Adaptive (MFA) control technology overcomes the shortcomings of traditional Proportional-Integral-Derivative (PID) controllers and is able to control various complex processes that may have one or more of the following behaviors: (1) nonlinear, (2) time-varying, (3) large time delay, (4) multi-input-multi-output, (5) frequent dynamic changes, (6) open-loop oscillating, (7) pH process, and (8) processes with large load changes and disturbances.

Since MFA is "Model-Free", it also overcomes the shortcomings of model-based advanced control methods. MFA is an adaptive and robust control technology but it does not require (1) precise process models, (2) process identification, (3) controller design, and (4) complicated manual tuning of controller parameters. A series of U.S. patents and related international patents for Model-Free Adaptive (MFA) control and optimization technologies have been issued. Some of them are listed in Table 1.

TABLE 1

| U.S. Pat. No. | Patent Name |
|---|---|
| 6,055,524 | Model-Free Adaptive Process Control |
| 6,556,980 | Model-Free Adaptive Control for Industrial Processes |
| 6,360,131 | Model-Free Adaptive Control for Flexible Production Systems |
| 6,684,115 | Model-Free Adaptive Control of Quality Variables (1) |
| 6,684,112 | Robust Model-Free Adaptive Control |
| 7,016,743 | Model-Free Adaptive Control of Quality Variables (2) |
| 7,142,626 | Apparatus and Method of Controlling Multi-Input-Single-Output Systems |
| 7,152,052 | Apparatus and Method of Controlling Single-Input-Multi-Output Systems |
| 7,415,446 | Model-Free Adaptive Optimization |

Commercial hardware and software products with Model-Free Adaptive control have been successfully installed in most industries and deployed on a large scale for process control, building control, and equipment control.

In the U.S. patent application No. 61/473,308, we described a 3×3 MFA control system to control key process variables including Power, Steam Throttle Pressure, and Steam Temperature of Boiler-Turbine-Generator (BTG) units in conventional and advanced power plants. Those advanced power plants may comprise Once-Through Supercritical (OTSC) Boilers, Circulating Fluidized-Bed (CFB) Boilers, and Once-Through Supercritical Circulating Fluidized-Bed (OTSC CFB) Boilers.

In this patent, we expand the invention by introducing a multivariable Model-Free Adaptive control system to control a 5-Input-5-Output (5×5) combustion process of Circulating Fluidized-Bed (CFB) Boilers and Once-Through Supercritical Circulating Fluidized-Bed (OTSC CFB) Boilers. We will also describe a novel MFA control system for controlling combined 3×3 BTG process and 5×5 CFB combustion process.

Figure 8:
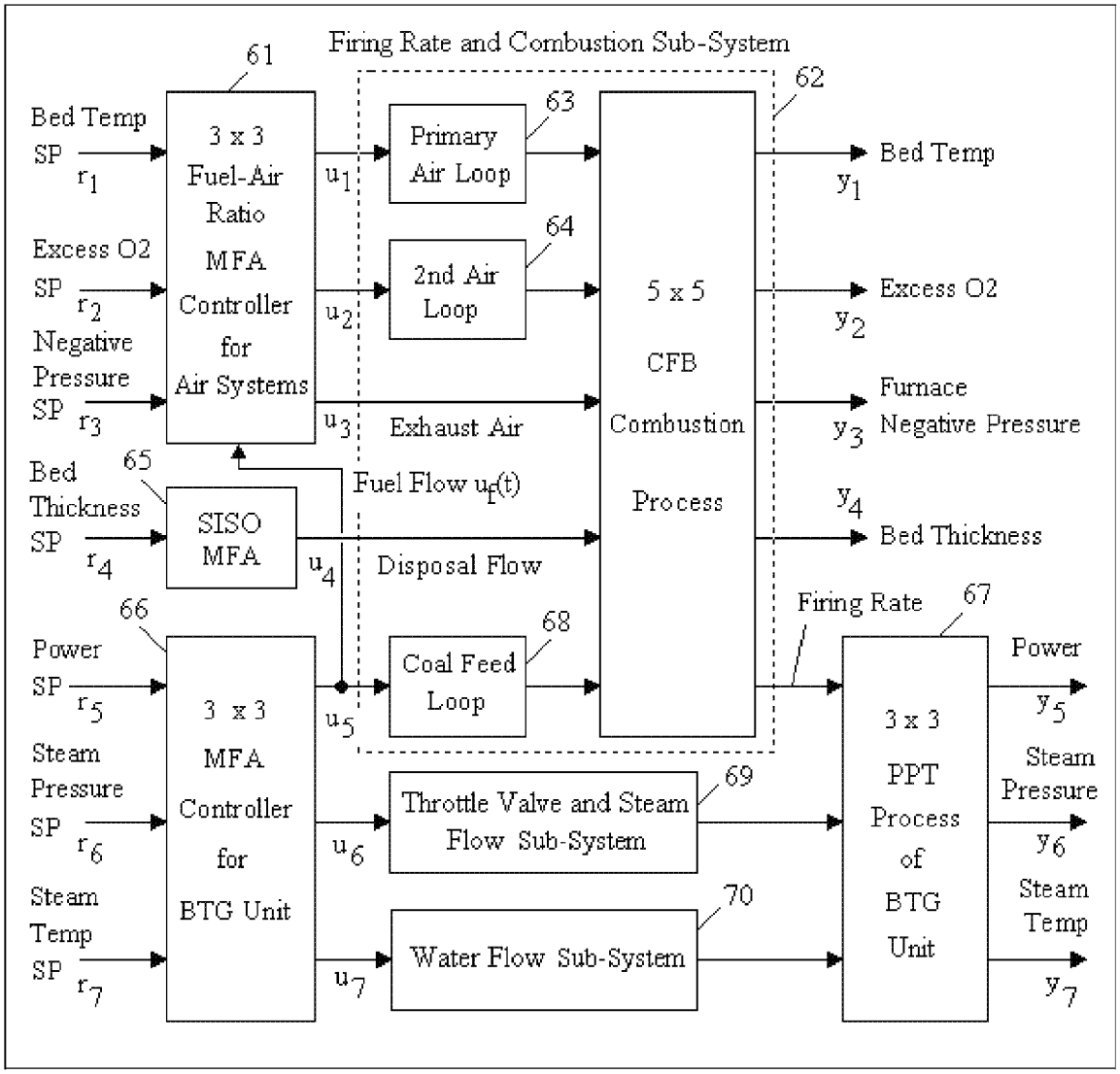
FIG. 8 is a block diagram illustrating a 7-input-7-output (7×7) Model-Free Adaptive (MFA) control system for controlling a combined 3×3 PPT process of a BTG unit and 5×5 CFB combustion process according to an embodiment of this invention.
Figure 14:
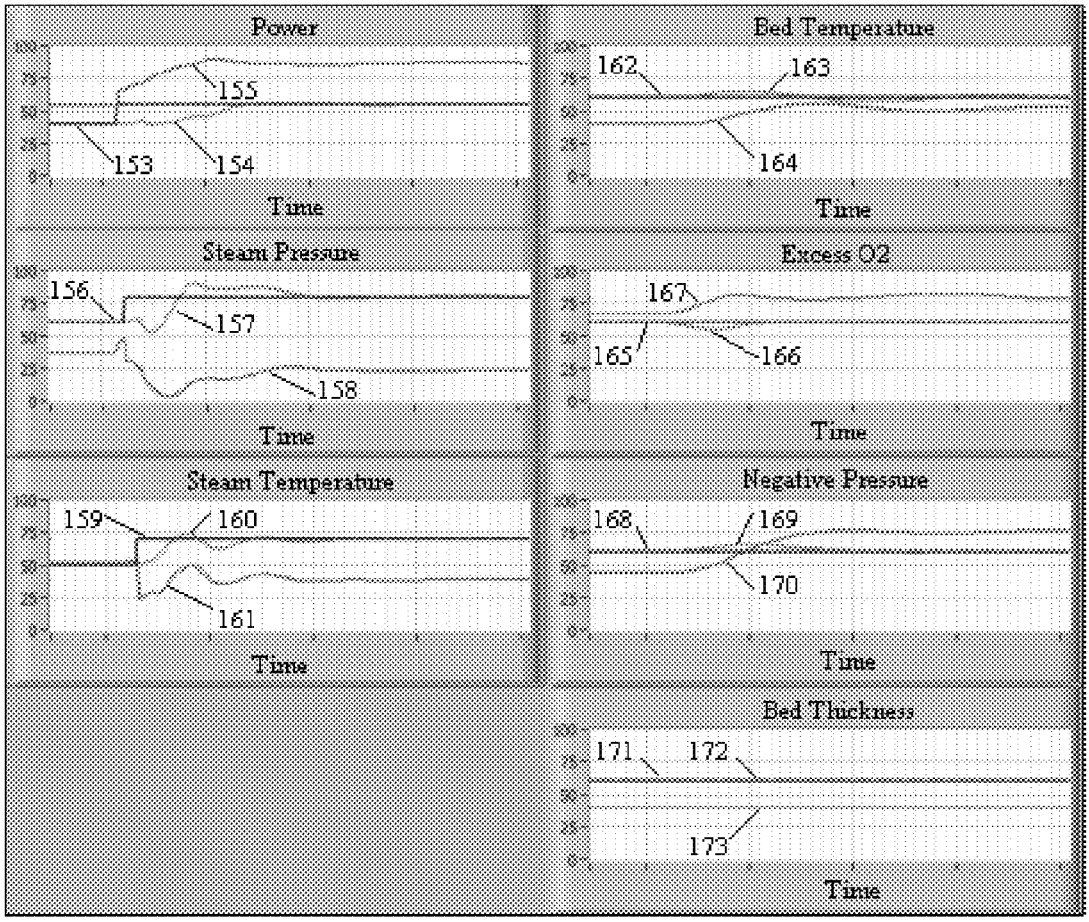

FIG. 14 is a time-amplitude diagram presenting the control performance of the 7×7 MFA control system described in FIG. 8 controlling a combined 3×3 PPT process of a BTG unit and 5×5 CFB combustion process including 7 control loops: Power, Steam Pressure, Steam Temperature, Bed Temperature, Excess O2, Furnace Negative Pressure, and Bed Thickness, where the setpoints of Power, Steam Pressure, and Steam Temperature are stepped up.

Figure 15:
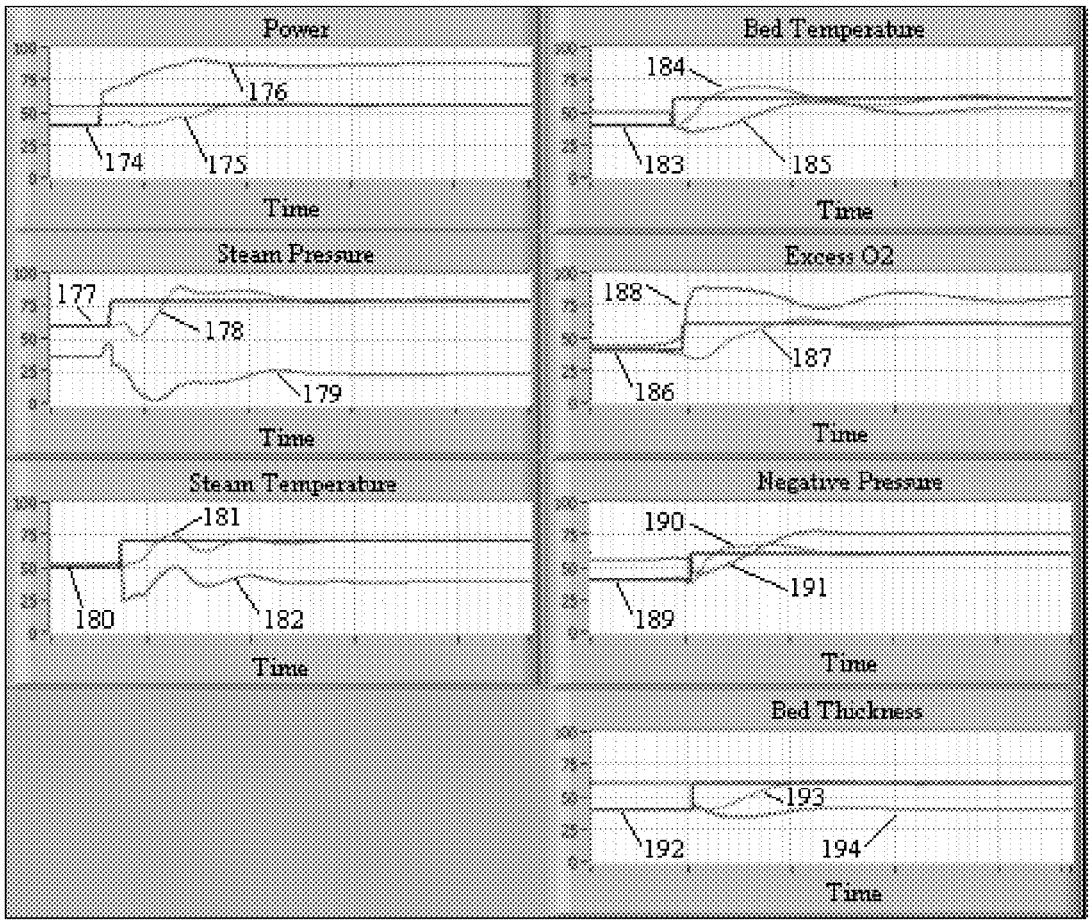

FIG. 15 is a time-amplitude diagram presenting the control performance of the 7×7 MFA control system described in FIG. 8 controlling a combined 3×3 PPT process of a BTG unit and 5×5 CFB combustion process including 7 control loops: Power, Steam Pressure, Steam Temperature, Bed Temperature, Excess O2, Furnace Negative Pressure, and Bed Thickness, where the setpoints of all 7 loops have step changes.

In this patent, the term "mechanism" is used to represent hardware, software, or any combination thereof. The term "process" is used to represent a physical system or process with inputs and outputs that have dynamic relationships.

Without losing generality, all numerical values given in controller parameters in this patent are examples. Other values can be used without departing from the spirit or scope of our invention.

For simplicity, all engineering values in the time-amplitude diagrams used to show control system performance are converted to the scale of 0 to 100.

DESCRIPTION

A. Advanced Power Boilers

Compared with sub-critical fixed bed conventional boilers, there are 3 types of advanced boilers: (1) Once-Through Supercritical (OTSC) Boilers, (2) Circulating Fluidized-Bed (CFB) Boilers, and (3) Once-Through Supercritical Circulating Fluidized-Bed (OTSC CFB) Boilers. Generally speaking, a power plant that is equipped with any number of advanced boilers can be called an advanced power plant.

Boilers used in energy plants are either "drum" or "once-through" types, depending on how the boiler water is circulated. Heat is transferred through the furnace tubes and into the water passing through the tubes to generate steam. In drum-type boilers, the steam-flow rate is typically controlled by the fuel-firing rate. In once-through boilers, the steam-flow rate is established by the boiler feedwater and the superheated steam temperature is controlled by the fuel-firing rate. A boiler is called supercritical when the master steam pressure is over 22.129 Mpa. In general, when water goes over the critical point (Pressure=22.129 Mpa, and Temperature=234 degree C.), it becomes steam. Therefore, a steam drum cannot be used and the Once-Through design is the only choice for supercritical boilers. Once-Through Supercritical boilers run at higher steam temperature and pressure so that better energy efficiency is achieved. But they are difficult to control as summarized in Table 2.

TABLE 2

| Challenges | Description and Comments |
|---|---|
| Severely Nonlinear and Multi-variable | The relationship of throttle valve, fuel feed, and water feed to power, steam pressure, and steam temperature are nonlinear and interacting. |
| Serious Coupling | Because of the once-through design, there exists serious coupling between the boiler and turbine units. |
| Large Disturbances | Since there is no steam drum, any changes in the throttle valve position will cause a direct disturbance to the boiler pressure and temperature. |
| Large load and operating condition changes | Boiler needs to run in both subcritical and supercritical modes causing large load and operating condition changes. |

Circulating Fluidized-Bed (CFB) boilers are becoming strategically important in power and energy generation. The unique design of CFB boilers allows fuel such as coal powders to be fluidized in the air so that they have better contact with the surrounding air for better combustion. CFB boilers can burn low-grade materials such as waste coal, wood, and refuse derived fuel. Most importantly, less emissions such as COx and NOx are produced compared to conventional boilers. The critical process variables and their control challenges for a CFB boiler are listed in Table 3. For a CFB boiler, the control challenges are mainly related to the combustion process of its furnace.

TABLE 3

| Process Variable | Control Challenges of CFB Boilers |
|---|---|
| Master Steam Pressure | Nonlinear, tight specifications, large delay time, large disturbance caused by load changes and poor feed actuation, etc. |
| Steam Temperature | Large time delay and time-varying. |
| Bed Temperature | Multi-input-single-output process, multiple constraints, very critical since poor bed temp control results in serious NO*x* emissions. |
| Excess Oxygen | It is related to multiple emission constraints, varying heating value of flexible fuel, and the condition of oxygen sensors. |
| Furnace Negative Pressure | Multiple fans and dampers to hold proper negative pressure for the furnace. |
| Coal or Fuel Feed | Nonlinear, poor actuation, coal or fuel feed jams, etc. |
| Primary Air and Secondary Air | Multiple fans and dampers to hold the proper CFB circulating condition and fuel-air-ratio. Extremely sensitive to bed temperature. |
| Bed Thickness | For highest heat transfer efficiency, it is important to run the CFB furnace at an optimal Bed Thickness. |

B. Supercritical CFB Boilers and BTG Units

Once-Through Supercritical Circulating Fluidized-Bed (OTSC CFB) Boilers or Supercritical CFB Boilers combine the merits of once-through supercritical and circulating fluidized-bed technologies. As a strategically important clean coal technology, Supercritical CFB boilers can significantly improve combustion and energy efficiency, reduce emissions, and have fuel flexibility. It is the most promising boiler for future energy plants because of all its outstanding advantages.

A Supercritical CFB boiler based electric power plant also consists of three key components: (1) Boiler, (2) Turbine, and (3) Generator. Similar to conventional boilers, a Supercritical CFB boiler produces superheated steam to turn the turbine to allow the generator to generate electricity. Operating as a set, the combined Boiler, Turbine, Generator, and all auxiliaries make up a BTG unit.

Figure 1:
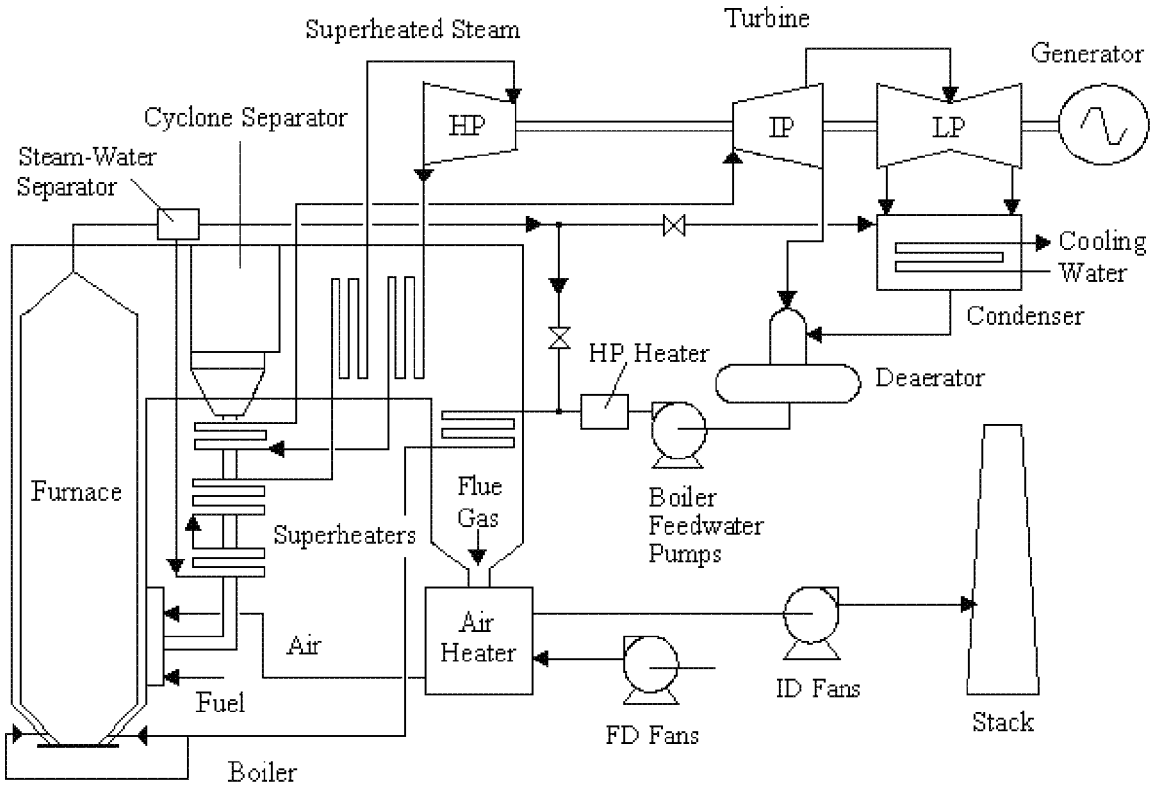
Fig. 1 (Prior Art)
FIG. 1 is a schematic representation of a Boiler-Turbine-Generator (BTG) unit of a power plant comprising a Supercritical Circulating Fluidized-Bed boiler.

FIG. 1 is a schematic representation of a Boiler-Turbine-Generator (BTG) unit of a power plant comprising a Supercritical CFB boiler. Feedwater first enters the Economizer where initial heating to almost boiling occurs. It then passes into the Cyclone Separator at the top of the Boiler. From there the water recirculates through the Superheaters. The superheated steam is fed directly to the Turbine which is coupled with the Generator. Steam is exhausted from the Turbine at a low pressure, condensed, and then pumped back to the boiler under pressure.

For a Supercritical CFB boiler, most of the control challenges in Supercritical boilers and in CFB boilers still exist. Since the Supercritical CFB boiler combines the chaotic operating conditions of a CFB boiler and the once-through nature of a supercritical boiler, the control challenges could double. For such a boiler, maintaining a dynamic material and energy balance becomes a big challenge. In general, for a Supercritical CFB boiler, its BTG process and its CFB combustion process are much more dependent on a good automatic control system in order to keep the energy and material balance. If not careful, the entire system can get into vicious cycles causing serious consequences. For instance, when a steam demand increases, it will cause the steam pressure to go down, which will quickly affect the boiler firing condition and then the fluidized-bed condition. The changed combustion condition will result in more changes in steam temperature and pressure and therefore a vicious cycle will build up causing major operation and safety problems. Conventional control methods including coordinated control of steam turbine and boiler control will have major difficulties in controlling Supercritical CFB boilers.

In a power generation network, a BTG unit may be base-loaded to generate at a constant rate, or may cycle up and down as required by an automatic dispatch system. In either case, the boiler control system manipulates the firing rate of the furnace to generate the steam required to satisfy the demand for power. It is also necessary to maintain an adequate supply of feedwater and the correct mixture of fuel and air for safe and economic combustion. These requirements are actually the same for a conventional BTG unit or a BTG unit that employs an advanced power boiler such as a Supercritical boiler, a CFB boiler, or a Supercritical CFB boiler.

Figure 2:
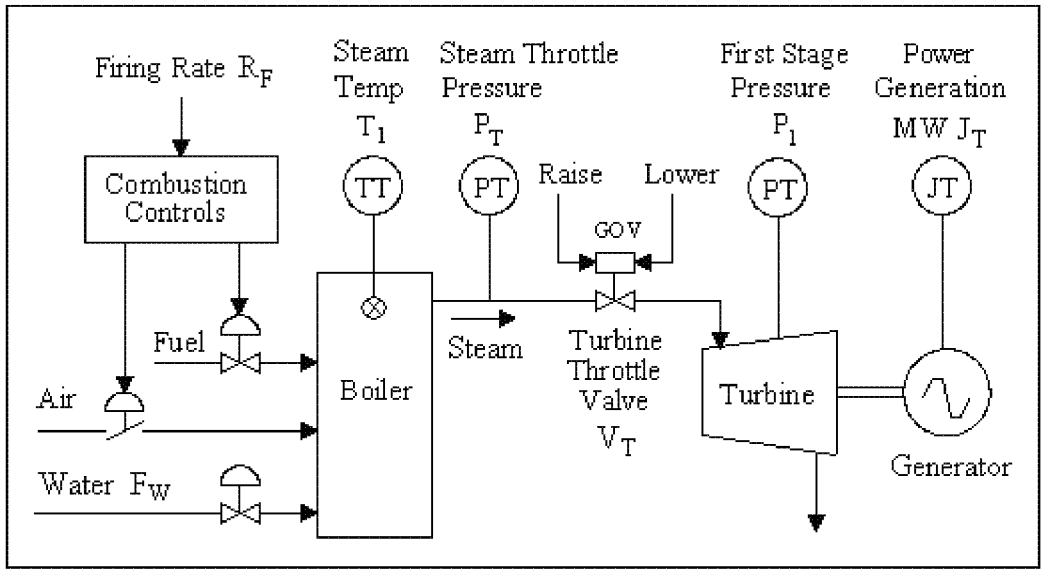
Fig. 2 (Prior Art)
FIG. 2 is a diagram illustrating the key process variables of the Boiler-Turbine-Generator (BTG) unit of a power plant that may comprise a CFB boiler, or a Supercritical CFB boiler.

FIG. 2 is a diagram illustrating the key process variables of the Boiler-Turbine-Generator (BTG) unit of a power plant that may comprise a CFB boiler, or a Supercritical CFB boiler. The key variables of a BTG unit are described in Table 4.

TABLE 4

| Variable | Symbol | Description |
|---|---|---|
| Throttle Valve Position | $V_T$ | The valve used for the Turbine governor control. |
| Firing Rate | $R_F$ | The firing rate of the boiler is changed by manipulating the amounts of air and fuel to the burners. Increasing the firing rate generates more steam. |
| Water Feed | $F_W$ | The feed water flow to the boiler. |
| Power Output | $J_T$ | The power measurement is used to indicate and control the power generation of the BTG unit. |
| Steam Throttle Pressure | $P_T$ | The steam throttle pressure is the steam supply pressure to the turbine. It indicates the state of balance between the supply and demand for steam. Rising throttle pressure indicates that the steam supply exceeds demand and falling throttle pressure indicates that the steam demand exceeds supply. The automatic controller for this purpose is the Turbine Governor. |
| Steam Flow | Fs | The steam flow. |
| Steam Temp 1 | $T_1$ | Temperature of superheated steam in position 1. |

C. MFA Control of BTG Units

As introduced in the U.S. patent application No. 61/473,308, the multivariable MFA control system design method has the following key points:

1. The control system design is based on qualitative analysis of the process input and output variables. No detailed quantitative analysis or process models are required.
2. For a multivariable process, use S (Strong), M (Medium), and W (Weak) to represent the degree of connections between the input and output of each sub-process. Use the plus or minus sign to represent whether the process is direct or reverse acting.
3. Properly pair the process input and output variables so that the main processes are open-loop stable and have a strong direct or reverse acting relationship to assure good controllability.
4. The remaining sub-processes should have medium, weak, or even no connections between their input and output variables. Their acting types do not matter.
5. If a sub-process has a strong relationship between its input and output, either improve the process or carefully launch the control system.

As introduced in the U.S. patent application No. 61/473,308, a 3×3 MFA control system is designed to control the critical process variables of the BTG unit including Power ($J_T$), Steam Throttle Pressure ($P_T$), and Steam Temperature $T_1$. The process has 3 inputs and 3 outputs and is called a Power-Pressure-Temperature (PPT) process. The 3×3 PPT process of a BTG unit includes 9 sub-processes $G_{11}, G_{21}, \ldots, G_{33}$ as listed in Table 5.

TABLE 5

| Process Inputs - Manipulated Variables | Process Outputs - Process Variables to be Controlled: Power ($J_T$) | Steam Throttle Pressure ($P_T$) | Steam Temp ($T_1$) |
|---|---|---|---|
| Firing Rate ($R_F$) | $G_{11}$ | $G_{21}$ | $G_{31}$ |
| Throttle Valve ($V_T$) | $G_{12}$ | $G_{22}$ | $G_{32}$ |
| Water Feed ($F_W$) | $G_{13}$ | $G_{23}$ | $G_{33}$ |

The importance of the variable pairing is that we want to make sure the 3 main processes $G_{11}$, $G_{22}$, and $G_{33}$ have a strong direct or reverse acting relationship so that they have good controllability.

Figure 3:
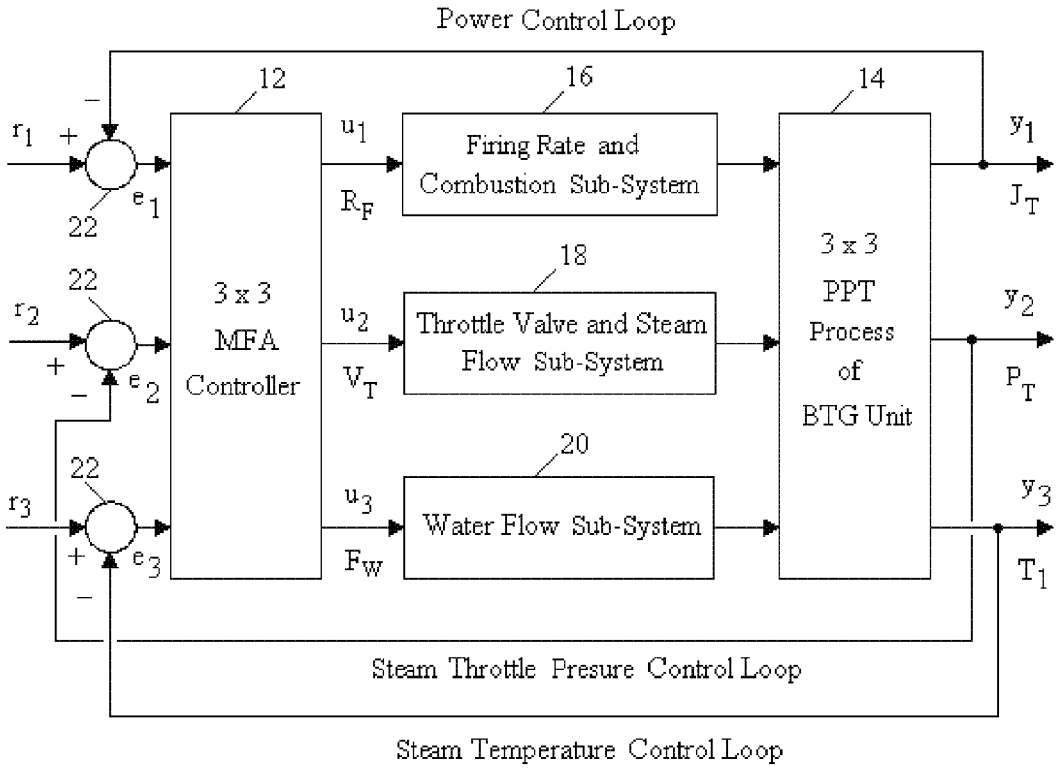
FIG. 3 illustrates the block diagram of a 3×3 MFA control system for controlling the 3×3 Power-Pressure-Temperature (PPT) process of a Boiler-Turbine-Generator (BTG) unit.

FIG. 3 illustrates the block diagram of a 3×3 MFA control system for controlling the 3×3 Power-Pressure-Temperature (PPT) process of a Boiler-Turbine-Generator (BTG) unit. The MFA control system comprises a 3×3 MFA controller 12, a 3×3 PPT process of a BTG unit 14, a Firing Rate and Combustion Sub-System 16, a Throttle Valve and Steam Flow Sub-System 18, and a Water Flow Sub-System 20.

The 3×3 PPT process has nine sub-processes $G_{11}$ through $G_{33}$ as listed in Table 5. The process variables $y_1$, $y_2$, and $y_3$ are Power ($J_T$), Steam Throttle Pressure ($P_T$), and Steam Temperature $T_1$, respectively. They are the feedback signals for each of the main control loops and compared with the setpoints $r_1$, $r_2$, and $r_3$ at adders 22 to produce error signals $e_1$, $e_2$, and $e_3$. The outputs of the 3×3 MFA controller $u_1$, $u_2$, and $u_3$ manipulate the manipulated variables Firing Rate ($R_F$), Throttle Valve ($V_T$), and Water Feed ($F_W$) to control the Power ($J_T$), Steam Throttle Pressure ($P_T$), and Steam Temperature $T_1$, respectively.

D. Combustion Process of a Supercritical CFB Boiler

Figure 4:
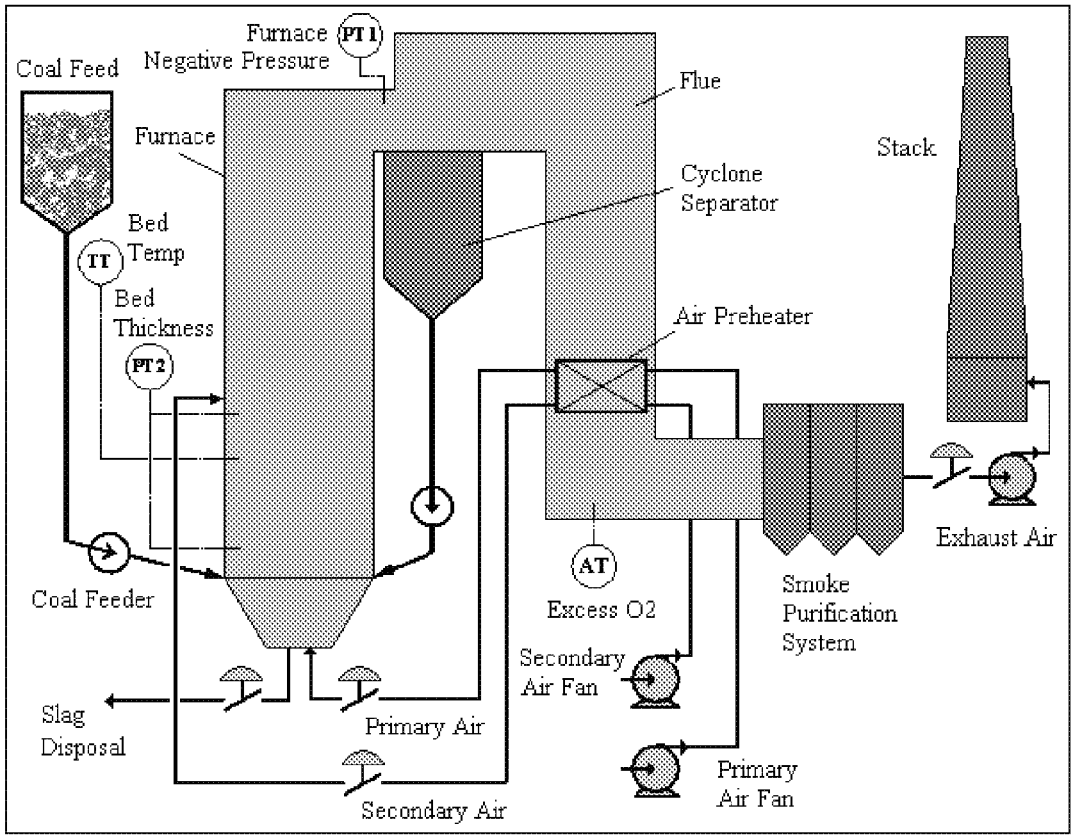
Fig. 4 (Prior Art)
FIG. 4 is a schematic representation of the combustion process of a Supercritical Circulating Fluidized-Bed (CFB) boiler.

FIG. 4 is a schematic representation of the combustion process of a Supercritical Circulating Fluidized-Bed (CFB) boiler. The core element of a CFB boiler is the CFB furnace where combustion is taking place.

Through the coal Feeder, fuel is fed to the lower furnace where it is burned in an upward flow of combustion air. Unburned fuel and ash leaving the furnace are collected by the Cyclone Separator and returned to the lower furnace. Limestone is also fed to the lower furnace for emission reduction.

Multiple fans and dampers are used to form the Primary Air, Secondary Air, and Exhaust Air as manipulated variables to achieve the following control objectives: (1) hold the proper CFB circulating condition, (2) keep the combustion fuel-air-ratio, and (3) control the furnace negative pressure. Since each manipulated variable can affect all three control objectives, this is a strongly coupled multivariable process. The air system of a CFB furnace is much more complex than a fixed-bed furnace because the CFB circulating condition has to be held as an additional control objective.

In a CFB furnace, there are 4 regions based on the vertical distribution of solids, which can be coal or fuel powder. They are the Bottom Region, Dense Region, Dilute Region, and Exit Region. The Bed Thickness can be roughly described as a process variable representing the thickness or the height of the dense region. It can be estimated using the pressure differential in the Dense Region of the CFB furnace. CFB boilers are typically operating in 50:1 ash to coal ratio. That means, during normal operation, only 2% of fresh coal or fuel powder is mixed with 98% coal ash that still has a lot of energy. Since the Dense Region has the highest heat transfer efficiency through direct contact to the furnace wall, it is important to run the CFB furnace at an optimal Bed Thickness.

If the Bed is too thin, the heat transfer efficiency will be low. If the Bed is too thick, it will not hold-up since it is the fluidized bed, which requires a sufficient amount of air and pressure to establish the bed. So, it is desirable to run the CFB furnace at the maximum Bed Thickness possible, while not causing other operating condition problems such as a fuel and air ratio mismatch. This indeed is a very complex problem, where the industry still does not have good answers to many of the questions. Typically, a trial-and-error based operation is the practice in real power plants, and the Bed Thickness is fixed at a relatively conservative and safe position. This results in low efficiency and potential CFB furnace shutdowns if the fuel type and size suddenly change. Automatic control of Bed Thickness is very important for the new generation of CFB boilers, especially Supercritical CFB boilers.

Slag Disposal is the ash leaving the CFB furnace. Because it affects the Bed Thickness directly, we use Slag Disposal as the manipulated variable for controlling the Bed Thickness. The Solids Recycle Feed is another process variable that can affect the Bed Thickness. Since manipulating this variable can only cause a temporary change to the Bed Thickness, it is best to leave it running at a constant rate.

Based on the multivariable MFA control system design method, we selected 5 pairs of variables with 25 sub-processes to form a 5-Input-5-Output CFB combustion process. The process inputs as manipulated variables and the process outputs as the process variables to be controlled are listed in Table 6.

TABLE 6

| | Process Outputs - Process Variables to be Controlled | | | | |
|---|---|---|---|---|---|
| Process Inputs - Manipulated Variables | Bed Temp ($T_B$) | Excess O2 ($O_2$) | Negative Pressure ($P_N$) | Bed Thickness ($D_B$) | Firing Rate ($R_F$) |
| Primary Air ($F_P$) | $H_{11}$ | $H_{21}$ | $H_{31}$ | $H_{41}$ | $H_{51}$ |
| Secondary Air ($F_S$) | $H_{12}$ | $H_{22}$ | $H_{32}$ | $H_{42}$ | $H_{52}$ |
| Exhaust Air ($F_E$) | $H_{13}$ | $H_{23}$ | $H_{33}$ | $H_{43}$ | $H_{53}$ |
| Slag Disposal ($F_D$) | $H_{14}$ | $H_{24}$ | $H_{34}$ | $H_{44}$ | $H_{54}$ |
| Coal Feed ($F_C$) | $H_{15}$ | $H_{25}$ | $H_{35}$ | $H_{45}$ | $H_{55}$ |

Figure 5:
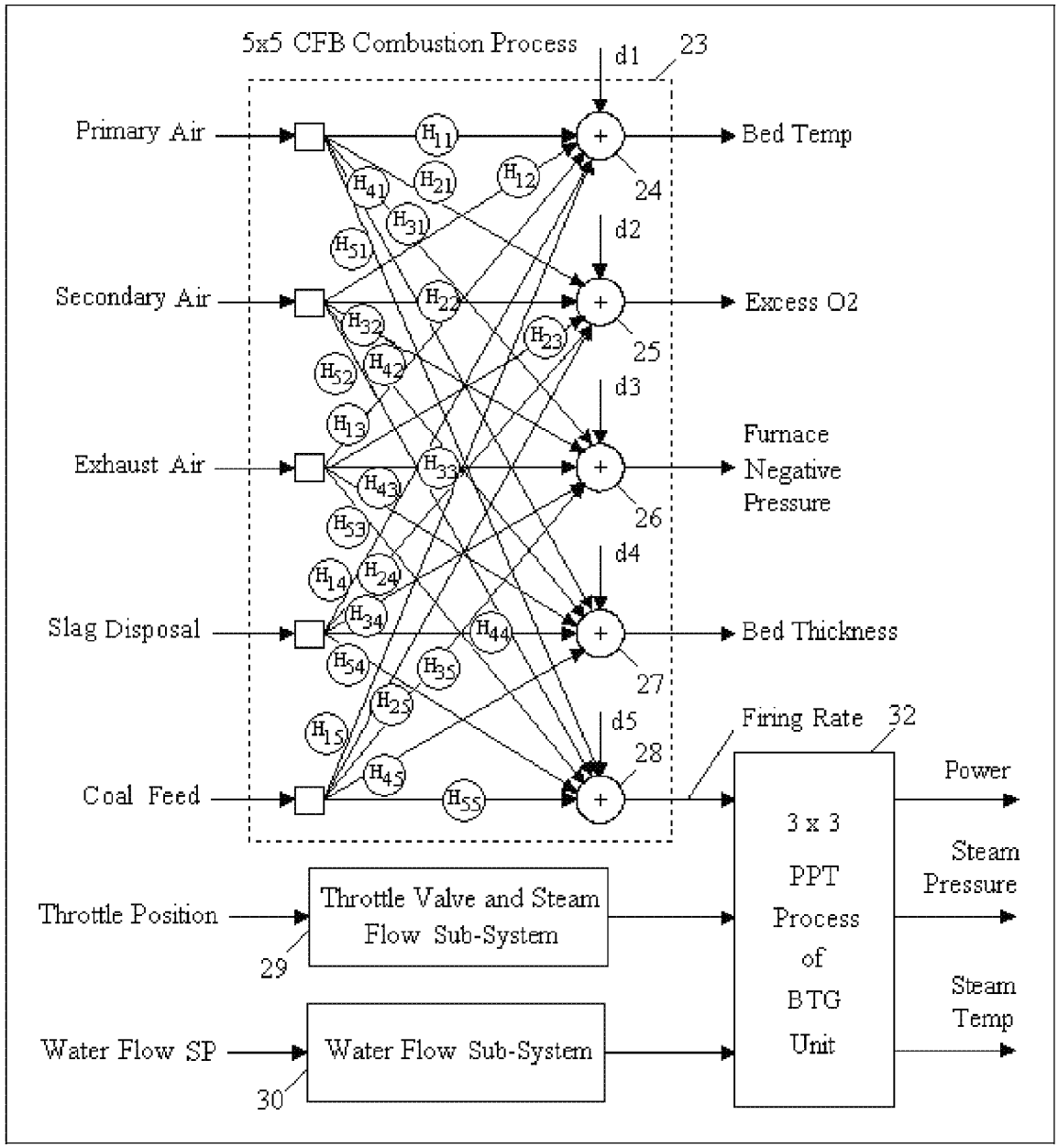
FIG. 5 is a block diagram illustrating a combined 5×5 CFB combustion process and 3×3 PPT process of a BTG unit according to an embodiment of this invention.

FIG. 5 is a block diagram illustrating a combined 5×5 CFB combustion process and 3×3 PPT process of a BTG unit according to an embodiment of this invention. The combined process comprises a 5×5 CFB Combustion Process 23, a 3×3 PPT Process of BTG Unit 32, a Throttle Valve and Steam Flow Sub-System 29, and a Water Flow Sub-System 30. It is interesting to see that the Firing Rate, a process output from the 5×5 combustion process, is the process input for the 3×3 BTG process. From a control point of view, the Firing Rate loop is an inner-loop for the 3×3 PPT process. In this design configuration, the 5×5 CFB combustion process and the 3×3 PPT process of the BTG unit are combined seamlessly to represent the main processes of a CFB boiler or a Supercritical CFB boiler.

In FIG. 5, the 5×5 CFB combustion process 23 includes 25 sub-processes $H_{11}$, $H_{21}$, . . . , $H_{55}$ as shown in Table 6. As a multivariable dynamic process, each process output is affected by multiple process inputs going through their corresponding sub-processes. For instance, Bed Temp is affected by Primary Air going through sub-process $H_{11}$, Secondary Air going through sub-process $H_{12}$, Exhaust Air going through sub-process $H_{13}$, Slag Disposal going through sub-process $H_{14}$, Coal Feed going through sub-process $H_{15}$, and disturbance d1. From a signal processing point of view, the output of each sub-processes $H_{11}$, $H_{12}$, $H_{13}$, $H_{14}$, $H_{15}$, and d1 are summed at adder 24 to produce the Bed Temp signal.

The importance of the variable pairing is that we want to make sure the 5 main processes $H_{11}$, $H_{22}$, $H_{33}$, $H_{44}$, and $H_{55}$ have a strong direct or reverse acting relationship so that they have good controllability. As part of Model-Free Adaptive (MFA) control system design strategy, we use S (Strong), M (Medium), and W (Weak) to represent the degree of connections between the input and output of each sub-process. We also use the plus or minus sign to represent whether the process is direct or reverse acting. The detailed qualitative input and output relationship among all 25 sub-processes is analyzed and presented in Table 7. They provide valuable information when we design and configure the MFA control system for controlling this complex process.

TABLE 7

| Process | Input-Output | Acting Type | Qualitative Input and Output Relationship |
|---|---|---|---|
| $H_{11}$ | $F_P$-$T_B$ | −S | Strong reverse acting. Primary Air has upper and lower constraints when used to control Bed Temp since it also needs to hold the proper fluidized bed condition. |
| $H_{21}$ | $F_P$-$O_2$ | M | Increasing Primary Air will cause O2 to increase. |
| $H_{31}$ | $F_P$-$P_N$ | M to S | Primary Air seriously affects Furnace Negative Pressure. |
| $H_{41}$ | $F_P$-$D_B$ | N | No major effect of Primary Air to Bed Thickness. |
| $H_{51}$ | $F_P$-$R_F$ | −M | Increasing Primary Air will cause Bed Temp to decrease and Exhaust Air Temp to increase causing a lower Firing Rate. |
| $H_{12}$ | $F_S$-$T_B$ | N | Since Secondary Air's entry point is above the Bed Temp measurement point, it has no effect. |
| $H_{22}$ | $F_S$-$O_2$ | S | Strong direct acting. Good fuel and air ratio is required. |
| $H_{32}$ | $F_S$-$P_N$ | M to S | Secondary Air seriously affects Furnace Negative Pressure. |
| $H_{42}$ | $F_S$-$D_B$ | N | No major effect of Secondary Air to Bed Thickness. |
| $H_{52}$ | $F_S$-$R_F$ | +/−M | Good fuel and air ratio control can minimize the effect. |
| $H_{13}$ | $F_E$-$T_B$ | +/−W | Exhaust Air has only little effect to Bed Temp. |
| $H_{23}$ | $F_E$-$O_2$ | +/−M | Increasing Exhaust Air will temporarily show more Excess O2 but will return to the balanced point. |
| $H_{33}$ | $F_E$-$P_N$ | −S | Increasing Exhaust Air causes Furnace Negative Pressure to drop further. Typically, Furnace Negative Pressure needs to be controlled in the range of −100 to −30 Pa. |
| $H_{43}$ | $F_E$-$D_B$ | N | No major effect of Exhaust Air to Bed Thickness. |
| $H_{53}$ | $F_E$-$R_F$ | −W | Exhaust Air has only a little effect to Firing Rate. |
| $H_{14}$ | $F_D$-$T_B$ | −M | Decreasing Disposal Flow will cause Bed Thickness to increase resulting in better heat transfer causing Bed Temp to increase. |
| $H_{24}$ | $F_D$-$O_2$ | N | No major effect of Disposal Flow to O2. |
| $H_{34}$ | $F_D$-$P_N$ | N | No major effect of Disposal Flow to Furnace Negative Pressure. |
| $H_{44}$ | $F_D$-$D_B$ | −S | Decreasing Disposal Flow will increase Bed Thickness, strong reverse acting. |
| $H_{54}$ | $F_D$-$R_F$ | −M | Decreasing Disposal Flow will cause Bed Thickness to increase resulting in better heat transfer causing Firing Rate to increase. |
| $H_{15}$ | $F_C$-$T_B$ | M to S | Coal Feed has medium to strong effect to Bed Temp. That is why it can also be used to control Bed Temp in certain operating conditions when Primary Air reaches its limit. |
| $H_{25}$ | $F_C$-$O_2$ | −M to −S | If Coal Feed increases but the air does not increase accordingly, it will cause O2 to drop significantly. |
| $H_{35}$ | $F_C$-$P_N$ | −W | Coal Feed has little effect on Furnace Negative Pressure. |
| $H_{45}$ | $F_C$-$D_B$ | N | Coal Feed is only 2% of the total circulating material for a 50:1 circulating ratio CFB furnace. Thus, no major effect of coal feed change to Bed Thickness. |
| $H_{55}$ | $F_C$-$R_F$ | S | Strong direct acting. Since coal needs time to burn and generate energy, there is an inevitable delay time, which makes this loop more difficult to control. |

E. Optimal CFB Combustion Control

Combustion is a complex sequence of exothermic chemical reactions with fuel and oxygen producing heat. For industrial furnaces that use fossil fuel (gas, oil, or coal), good combustion control is desirable. Good combustion requires the correct amount of oxygen. Too little air results in CO formation, soot, and even explosion. Too much air will result in excessive NOx emissions and low efficiency due to the heat loss. In practice, an optimal combustion control condition can be considered at the point where Excess O2=2%, and CO2, H2, and CO are all under 100 ppm (portion per million).

Optimal combustion control is about finding the optimal fuel-air-ratio dynamically in the sense of most efficient combustion and meeting the emission requirements of COx, NOx and SOx. There are many ambient and atmospheric conditions that can affect the optimal fuel-air-ratio. For example, cold air is denser and contains more oxygen than warm air; wind speed affects the stack; and barometric pressure affects the draft, etc. Using oxygen sensors to measure the excess O2 in flue gas, O2 trim control can be implemented with an O2 control loop.

Figure 6:
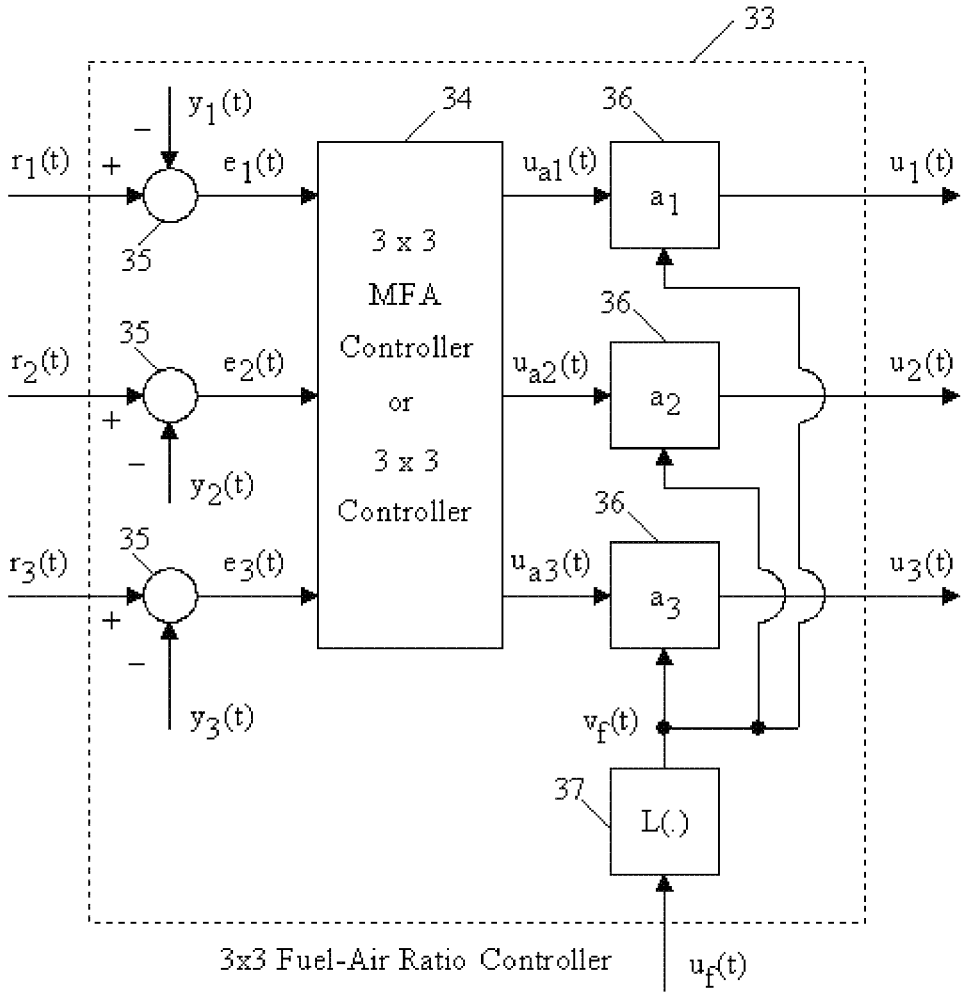
FIG. 6 is a block diagram illustrating a 3-input-3-output (3×3) Fuel-Air Ratio Controller according to an embodiment of this invention.

FIG. 6 is a block diagram illustrating a 3-input-3-output (3×3) Fuel-Air Ratio Controller according to an embodiment of this invention. Without losing generality, the 3×3 Fuel-Air Ratio Controller 33 comprises a 3×3 MFA Controller or a 3×3 Controller 34, three signal adders 35, three calculation blocks 36, and one scaling block 37. Since the CFB combustion process includes Bed Temp, Excess O2, and Furnace Negative Pressure loops, a 3×3 Fuel-Air Ratio controller for controlling CFB combustion process is developed according to an embodiment of this invention based on the following formula:

$$v_f(t)=L[u_f(t)], \tag{1}$$

$$u_1(t)=a_1v_f(t)+\Delta u_{a1}(t), \tag{2a}$$

$$u_2(t)=a_2v_f(t)+\Delta u_{a2}(t), \tag{2b}$$

$$u_3(t)=a_3v_f(t)+\Delta u_{a3}(t). \quad (2c)$$

In these equations, $u_f(t)$ is the fuel flow signal, L(.) is a scaling function to scale the fuel flow signal $u_f(t)$ to a control signal $v_f(t)$ in the range of 0 to 100, $\Delta u_{a1}(t)$, $\Delta u_{a2}(t)$, $\Delta u_{a3}(t)$ are controller output incremental signals from the 3×3 MFA controller or the 3×3 controller, $a_1$, $a_2$, $a_3$ are fuel-air ratio parameters, and $u_1(t)$, $u_2(t)$, $u_3(t)$ are controller outputs of the 3×3 Fuel-Air Ratio Controller. The fuel-air ratio parameters are related to the fuel type and grade, and can be determined by certain formulas and experimentation.

The 3×3 MFA controller that can be used in this embodiment has been described in the U.S. patent application No. 61/473,308. The 3×3 controller that can be used in this embodiment are any of a number of well known automatic controllers that are developed based on the control methods described in the "Instrument Engineers' Handbook—Process Control and Optimization," edited by Bela Liptak, published by CRC Press in 2005, including PID Control, Model-Based Control, Model-Free Adaptive (MFA) Control, Model Predictive Control, and Nonlinear and Adaptive Control.

Figure 7:
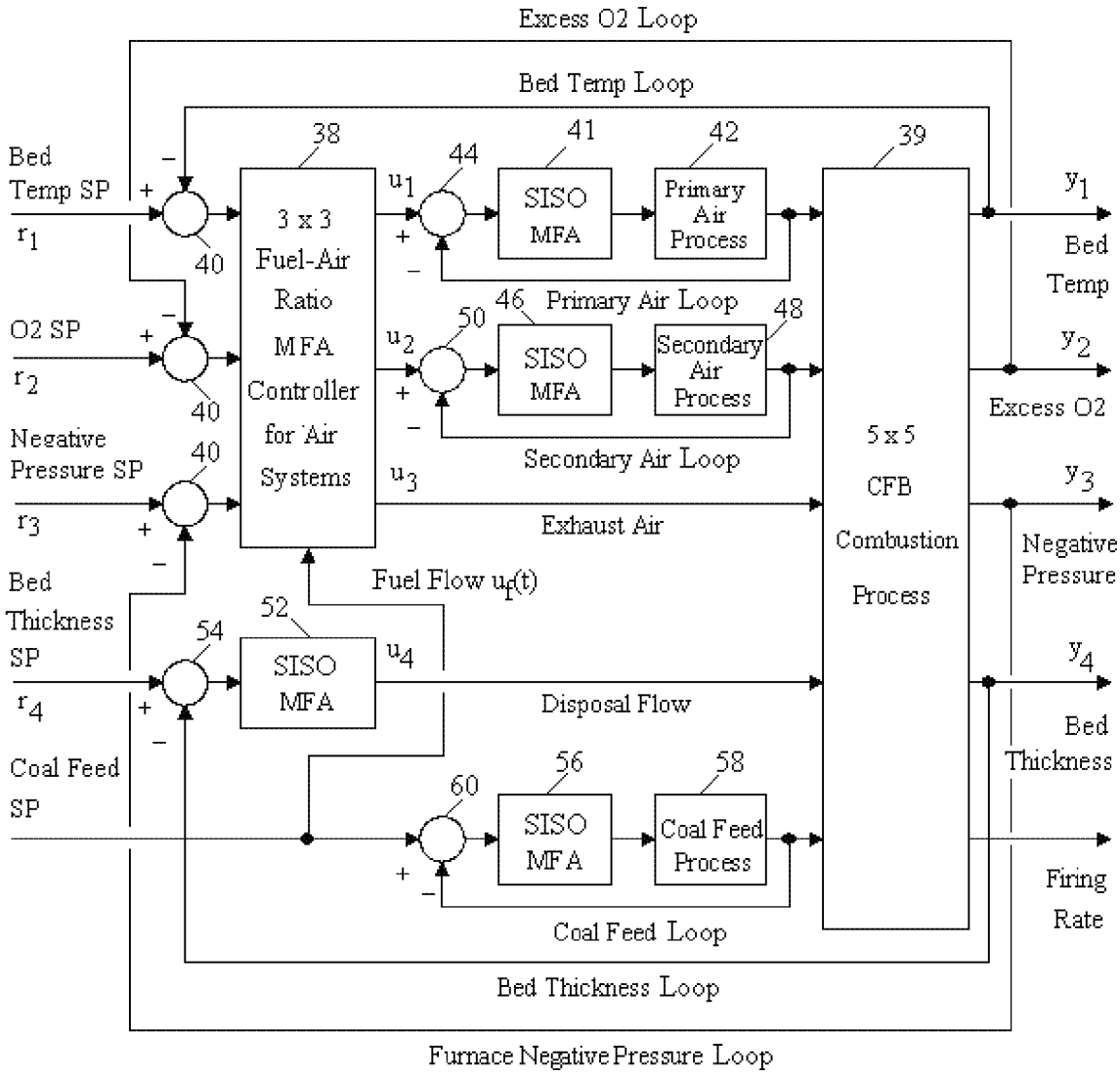
FIG. 7 is a block diagram illustrating a multivariable Model-Free Adaptive (MFA) control system for controlling the 5×5 CFB combustion process according to an embodiment of this invention.

FIG. 7 is a block diagram illustrating a multivariable Model-Free Adaptive (MFA) control system for controlling the 5×5 CFB combustion process according to an embodiment of this invention. The MFA control system for CFB combustion comprises a 3×3 Fuel-Air Ratio MFA Controller for Air Systems 38 and a SISO MFA Controller 52 to control the Bed Temp, Excess O2, Furnace Negative Pressure, and Bed Thickness of the 5×5 CFB Combustion Process 39. The 3×3 Fuel-Air Ratio MFA Controller for Air Systems 38 has been described in FIG. 6.

As shown in FIG. 7, the 3×3 Fuel-Air Ratio MFA Controller for Air Systems 38 is cascaded with 2 SISO MFA controllers 41 and 46 to control the process variables Bed Temp, O2, and Furnace Negative Pressure. Since the Primary Air and Secondary Air processes are nonlinear and need to be well controlled, we use two SISO MFA controllers to control the corresponding air flows. The SISO MFA controller 41 controls the Primary Air process 42, and adder 44 is used to form the Primary Air feedback loop. The SISO MFA controller 46 controls the Secondary Air process 48, and adder 50 is used to form the Secondary Air feedback loop. The Exhaust Air does not include an inner loop since it is easy to manipulate. A SISO MFA controller 52 is used to control the Bed Thickness by manipulating the Disposal Flow. Adder 54 is used to form the Bed Thickness feedback loop. The MFA controller can provide prompt and proper control actions to keep Bed Thickness within its operating range when it is approaching its high or low operating limits. If Bed Thickness goes beyond its operating limit, it can result in poor combustion or loss of fluidized-bed due to changes in fuel heating value, fuel powder size, etc. For the Bed Temp, Excess O2, Furnace Negative Pressure, and Bed Thickness loops, the setpoints (SP) are $r_1$, $r_2$, . . . , $r_4$; the controller outputs (OP) are $u_1$, $u_2$, . . . , $u_4$; and controlled process variables (PV) are $y_1$, $y_2$, . . . , $y_4$, respectively.

A SISO MFA controller 56 is used to control the Coal Feed flow. Adder 60 is used to form the Coal Feed feedback loop. The SISO MFA controllers that can be used in this embodiment have been described in U.S. Pat. Nos. 6,055,524 and 6,556,980. The Fuel Flow signal $u_f(t)$ connected with the Coal Feed setpoint is a critical input signal for the 3×3 Fuel-Air Ratio MFA Controller 38 since it is the leading signal for fuel-air ratio control.

F. Control of Supercritical Circulating Fluidized-Bed Boilers

FIG. 8 is a block diagram illustrating a 7-input-7-output (7×7) Model-Free Adaptive (MFA) control system for controlling a combined 3×3 PPT process of a BTG unit and 5×5 CFB combustion process according to an embodiment of this invention. The control system comprises 7 main loops: Power, Steam Pressure, Steam Temp, Bed Temp, Excess O2, Furnace Negative Pressure, and Bed Thickness. It also comprises 5 sub-systems: Primary Air, Secondary Air, Coal Feed, Steam Flow, and Water Flow.

The control system comprises a 3×3 Fuel-Air Ratio MFA Controller for Air Systems 61, a 5×5 CFB Combustion Process 62, a SISO MFA Controller 65, a 3×3 MFA Controller for BTG Unit 66, and a 3×3 PPT Process of BTG Unit 67. For this 7×7 MFA control system, the setpoints (SP) are $r_1$, $r_2$, . . . , $r_7$; the controller outputs (OP) are $u_1$, $u_2$, . . . , $u_7$; and controlled process variables (PV) are $y_1$, $y_2$, . . . , $y_7$, respectively. The feedback loops and signal adders are not drawn due to the limited space of the figure. The 3×3 Fuel-Air Ratio MFA Controller for Air Systems 61 has been described in FIG. 6.

Within the 3×3 MFA control system for controlling the 3×3 Power-Pressure-Temperature (PPT) process of a Boiler-Turbine-Generator (BTG) unit, there are 3 sub-systems including the Firing Rate and Combustion Sub-System 62, Throttle Valve and Steam Flow Sub-System 69, and Water Flow Sub-System 70. Each of the sub-systems may include various control loops. For instance, the Water Flow Sub-System typically includes a water flow control loop. In this case, control signal $u_7$ from the 3×3 MFA controller 66 is used as the setpoint for the water flow control loop, which is the inner loop of the cascade control system. MFA controllers or conventional controllers could be used to control these sub-systems.

Within the Firing Rate and Combustion Sub-System 62, there are three second layer sub-systems including the Primary Air Sub-System 63, Secondary Air Sub-System 64, and Coal Feed Sub-System 68. SISO MFA controllers can be used in these sub-systems as illustrated and described in FIG. 7. The 3×3 MFA controller that can be used in this embodiment has been described in the U.S. patent application No. 61/473,308.

Figure 9:
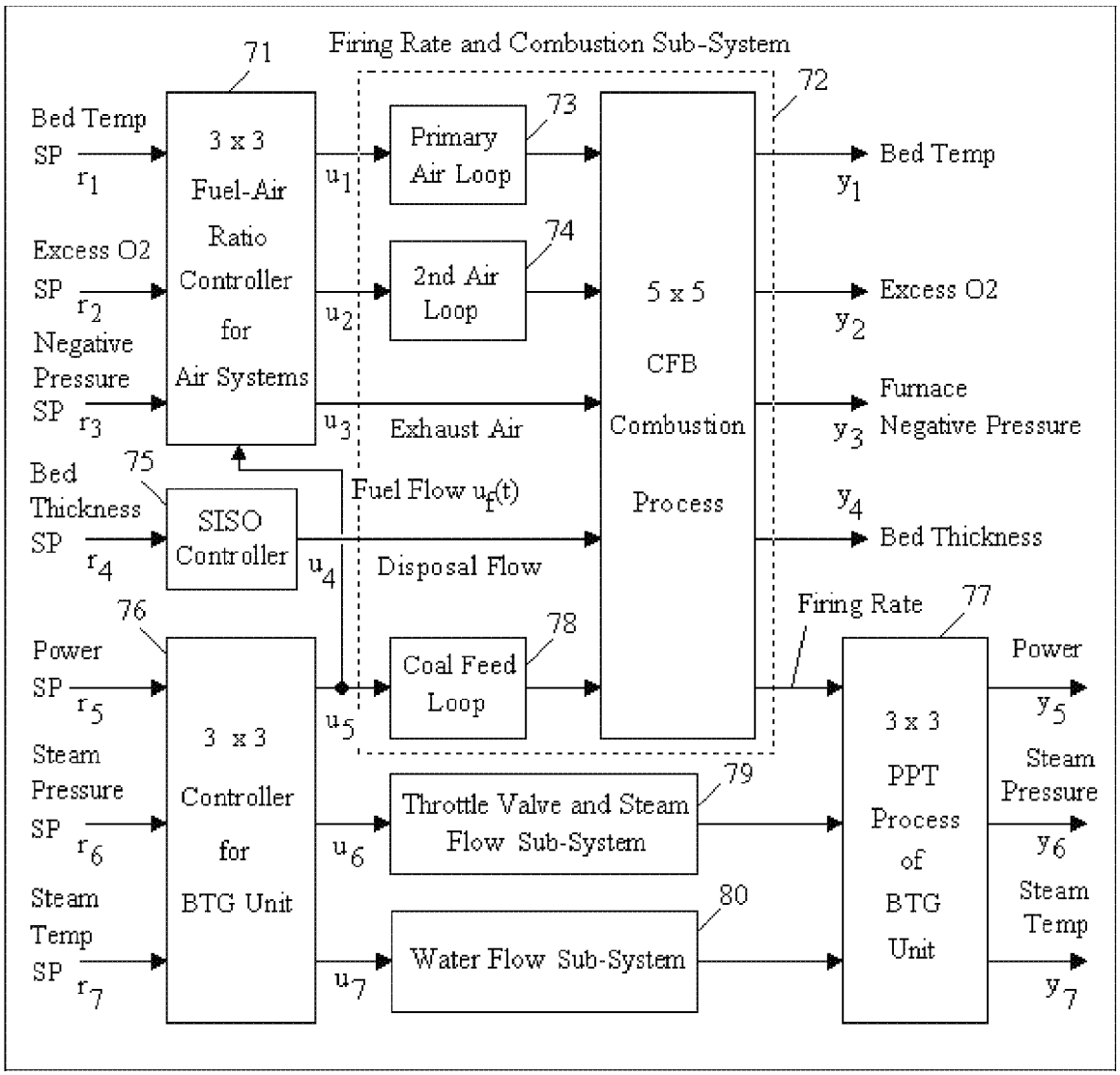
FIG. 9 is a block diagram illustrating a 7-input-7-output (7×7) control system for controlling a combined 3×3 PPT process of a BTG unit and 5×5 CFB combustion process according to an embodiment of this invention.

FIG. 9 is a block diagram illustrating a 7-input-7-output (7×7) control system for controlling a combined 3×3 PPT process of a BTG unit and 5×5 CFB combustion process according to an embodiment of this invention. The control system comprises 7 main loops: Power, Steam Pressure, Steam Temp, Bed Temp, Excess O2, Furnace Negative Pressure, and Bed Thickness. It also comprises 5 sub-systems: Primary Air, Secondary Air, Coal Feed, Steam Flow, and Water Flow.

Without losing generality, the control system comprises a 3×3 Fuel-Air Ratio Controller for Air systems 71, a 5×5 CFB Combustion Process 72, a SISO Controller 75, a 3×3 Controller for BTG Unit 76, and a 3×3 PPT Process of BTG Unit 77. For this 7×7 control system, the setpoints (SP) are $r_1$, $r_2$, $r_7$; the controller outputs (OP) are $u_1$, $u_2$, . . . , $u_7$; and controlled process variables (PV) are $y_1$, $y_2$, . . . , $y_7$, respectively. The feedback loops and signal adders are not drawn due to the limited space of the figure.

Within the 3×3 control system for controlling the 3×3 Power-Pressure-Temperature (PPT) process of a Boiler-Turbine-Generator (BTG) unit, there are 3 sub-systems including the Firing Rate and Combustion Sub-System 72, Throttle Valve and Steam Flow Sub-System 79, and Water Flow Sub-System 80. Each of the sub-systems may include various control loops. For instance, the Water Flow Sub-System typically includes a water flow control loop. In this case, control signal $u_7$ from the 3×3 controller 76 is used as the setpoint for the water flow control loop, which is the inner loop of the cascade control system. Within the Firing Rate and Combustion Sub-System 72, there are three second layer sub-systems including the Primary Air Sub-System 73, Secondary Air Sub-System 74, and Coal Feed Sub-System 78.

The SISO controller and 3×3 controllers that can be used in this embodiment are any of a number of well known automatic controllers that are developed based on the control methods described in the "Instrument Engineers' Handbook—Process Control and Optimization," edited by Bela Liptak, published by CRC Press in 2005, including PID Control, Model-Based Control, Model-Free Adaptive (MFA) Control, Model Predictive Control, and Nonlinear and Adaptive Control.

G. Control Experiments and Simulation Results

Under the projects of SBIR grant DE-FG02-06ER84599 awarded by the U.S. Department of Energy, extensive research and development have been performed including the development of real-time simulation models for the 3×3 Power-Pressure-Temperature (PPT) process of BTG units, 4×4 CFB combustion processes, 5×5 CFB combustion processes, combined BTG and CFB processes, and Supercritical CFB boilers. In addition, automatic controllers including the 3×3 MFA controller described in the U.S. patent application No. 61/473,308 as well as the 3×3 Fuel-Air Ratio MFA controller described in this patent application have been developed in real-time control software platforms. In FIGS. 10 to 15, real-time control simulation results using the appropriate MFA controllers and process models are provided to demonstrate the performance of the control technology described in this patent.

Figure 10:
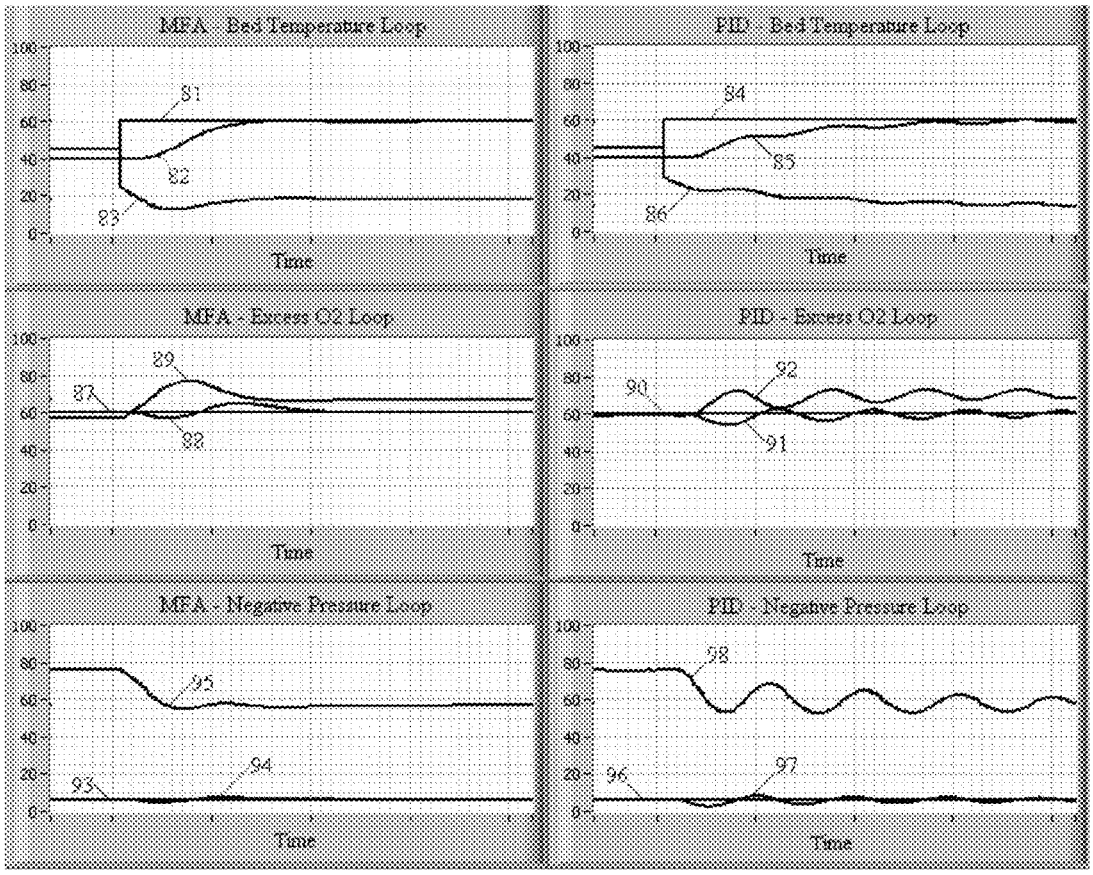
FIG. 10 is a time-amplitude diagram comparing the control performance of a 3×3 MFA control system versus a PID control system for controlling two identical CFB boiler combustion processes comprising Bed Temp, Excess O2, and Furnace Negative Pressure loops, where the setpoint for Bed Temperature is stepped up.

FIG. 10 is a time-amplitude diagram comparing the control performance of a 3×3 MFA control system versus a PID control system for controlling two identical CFB boiler combustion processes comprising Bed Temp, Excess O2, and Furnace Negative Pressure loops, where the setpoint for Bed Temperature is stepped up. In this case, the 3×3 Fuel-Air Ratio MFA Controller for Air Systems 38 described in FIG. 7 controls the Bed Temp, Excess O2, and Furnace Negative Pressure loops by manipulating Primary Air, Secondary Air, and Exhaust Air at the same time in a coordinated way. On the other hand, 3 single-loop PID controllers are used to control the Bed Temp, Excess O2, and Furnace Negative Pressure loops by manipulating Primary Air, Secondary Air, and Exhaust Air, individually. Since these 3 loops are seriously coupled, it is difficult for the PID controllers to achieve good control performance and robustness.

In FIG. 10, curves 81, 82, 83 are SP, PV, OP of the MFA Bed Temperature loop, and curves 84, 85, 86 are SP, PV, OP of the PID Bed Temperature loop, respectively. Curves 87, 88, 89 are SP, PV, OP of the MFA Excess O2 loop, and curves 90, 91, 92 are SP, PV, OP of the PID Excess O2 loop, respectively. Curves 93, 94, 95 are SP, PV, OP of the MFA Furnace Negative Pressure loop, and curves 96, 97, 98 are SP, PV, OP of the PID Furnace Negative Pressure loop, respectively. The loop interactions can be clearly seen. When the Bed Temperature SP (Signals 81 and 84) is changed from 45 to 60, the controller OP (Signals 83 and 86) produces the control actions trying to force the Bed Temperature PV (Signals 82 and 85) to track its setpoint. Since it is a 3×3 process, this action inevitably causes the Excess O2 PV (Signals 88 and 91) and Temperature PV (Signals 94 and 97) to change as well.

Figure 11:
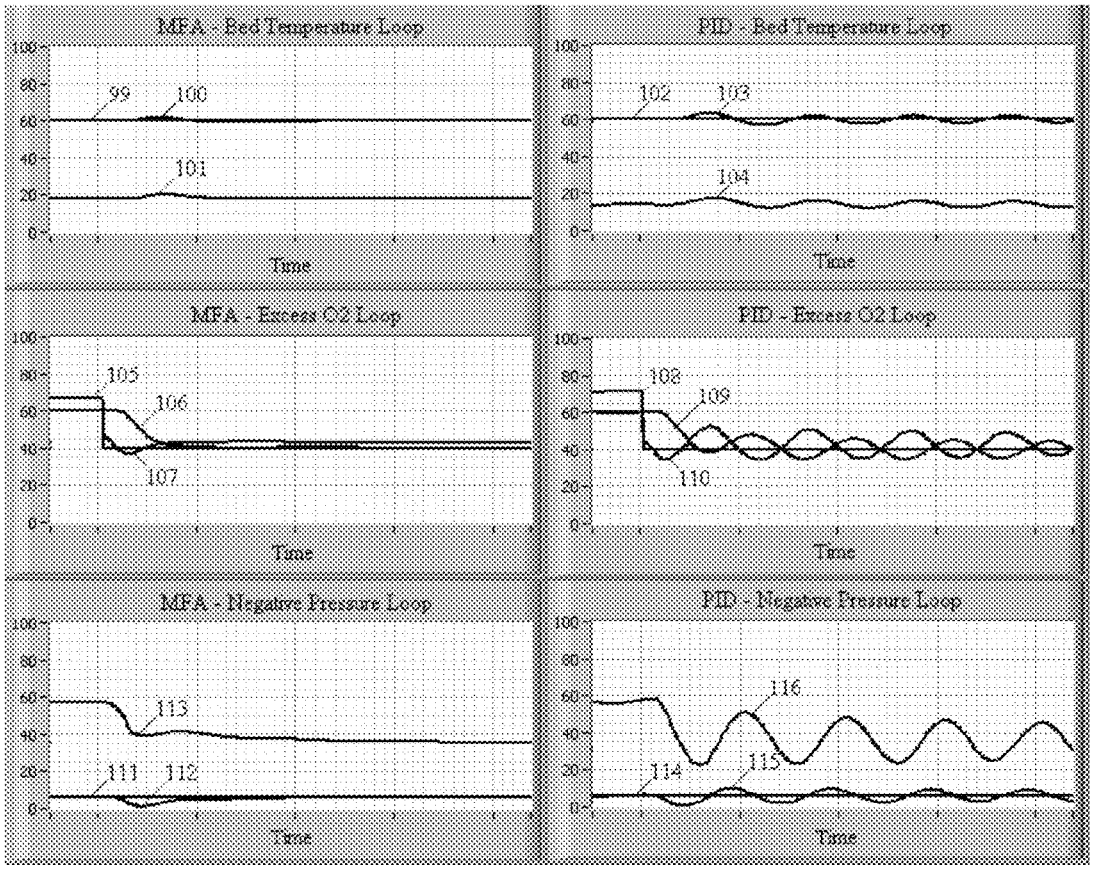
FIG. 11 is a time-amplitude diagram comparing the control performance of a 3×3 MFA control system versus a PID control system for controlling two identical CFB boiler combustion processes comprising Bed Temp, Excess O2, and Furnace Negative Pressure loops, where the setpoint for Excess O2 is stepped down.

FIG. 11 is a time-amplitude diagram comparing the control performance of a 3×3 MFA control system versus a PID control system for controlling two identical CFB boiler combustion processes comprising Bed Temp, Excess O2, and Furnace Negative Pressure loops, where the setpoint for Excess O2 is stepped down. In FIG. 11, curves 99, 100, 101 are SP, PV, OP of the MFA Bed Temperature loop, and curves 102, 103, 104 are SP, PV, OP of the PID Bed Temperature loop, respectively. Curves 105, 106, 107 are SP, PV, OP of the MFA Excess O2 loop, and curves 108, 109, 110 are SP, PV, OP of the PID Excess O2 loop, respectively. Curves 111, 112, 113 are SP, PV, OP of the MFA Furnace Negative Pressure loop, and curves 114, 115, 116 are SP, PV, OP of the PID Furnace Negative Pressure loop, respectively. From the trends, it is seen that the O2 loop is more difficult to control as it is sensitive to the setpoint and operating condition changes. When the Excess O2 SP (Signals 105 and 108) is changed from 67.5 to 40, the controller OP (Signals 107 and 110) produces the control actions trying to force the O2 PV (Signals 106 and 109) to track its setpoint. The MFA O2 loop shows very good performance as its O2 PV (Signal 106) tracks its SP change quite nicely. In contrast, the PID O2 loop oscillates which causes the Furnace Pressure loop to oscillate as well.

Figure 12:
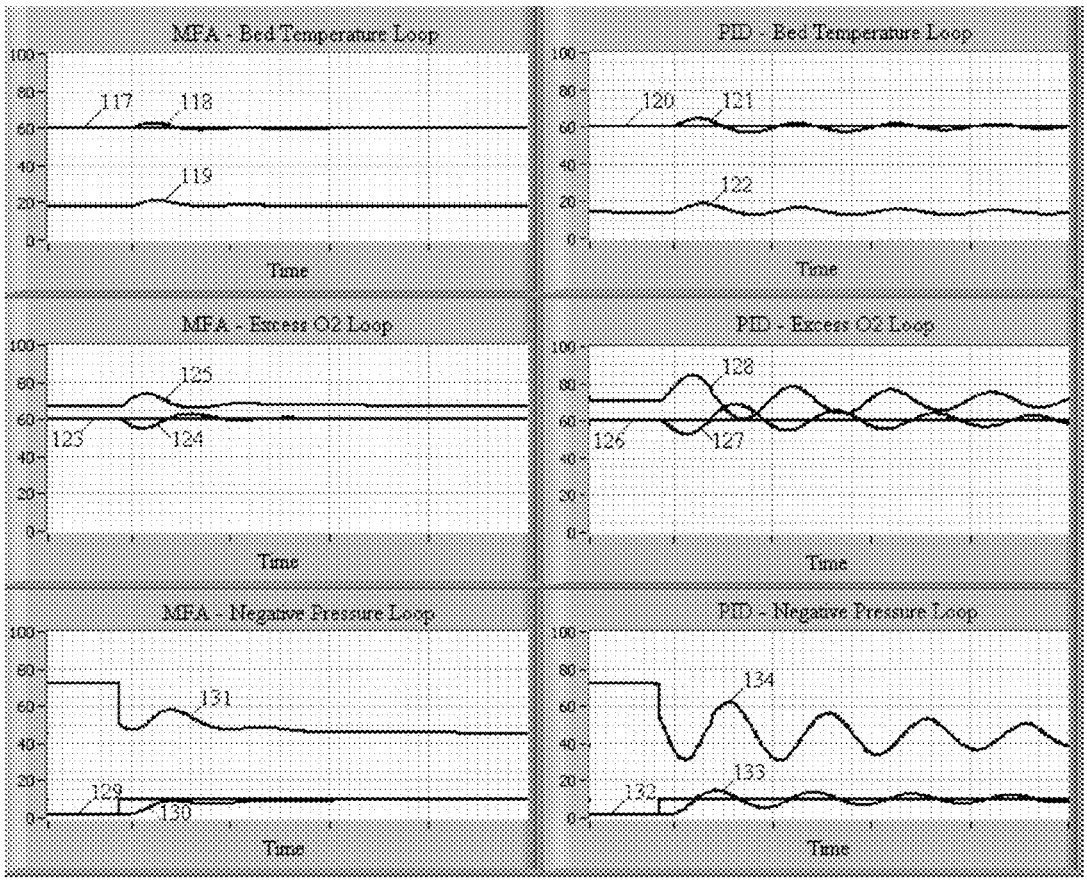
FIG. 12 is a time-amplitude diagram comparing the control performance of a 3×3 MFA control system versus a PID control system for controlling two identical CFB boiler combustion processes comprising Bed Temp, Excess O2, and Furnace Negative Pressure loops, where the setpoint for Negative Pressure is stepped up.

FIG. 12 is a time-amplitude diagram comparing the control performance of a 3×3 MFA control system versus a PID control system for controlling two identical CFB boiler combustion processes comprising Bed Temp, Excess O2, and Furnace Negative Pressure loops, where the setpoint for Furnace Pressure is stepped up. In FIG. 12, curves 117, 118, 119 are SP, PV, OP of the MFA Bed Temperature loop, and curves 120, 121, 122 are SP, PV, OP of the PID Bed Temperature loop, respectively. Curves 123, 124, 125 are SP, PV, OP of the MFA Excess O2 loop, and curves 126, 127, 128 are SP, PV, OP of the PID Excess O2 loop, respectively. Curves 129, 130, 131 are SP, PV, OP of the MFA Furnace Negative Pressure loop, and curves 132, 133, 134 are SP, PV, OP of the PID Furnace Negative Pressure loop, respectively. As illustrated, the 3×3 MFA control system can suppress the disturbances in the Bed Temperature and Excess O2 loops caused by the change in the Exhaust Air (Signal 131 and 134), which is the manipulated variable of the Furnace Negative Pressure loop. In contrast, the same disturbance causes the PID loops especially the O2 loop to swing.

Figure 13:
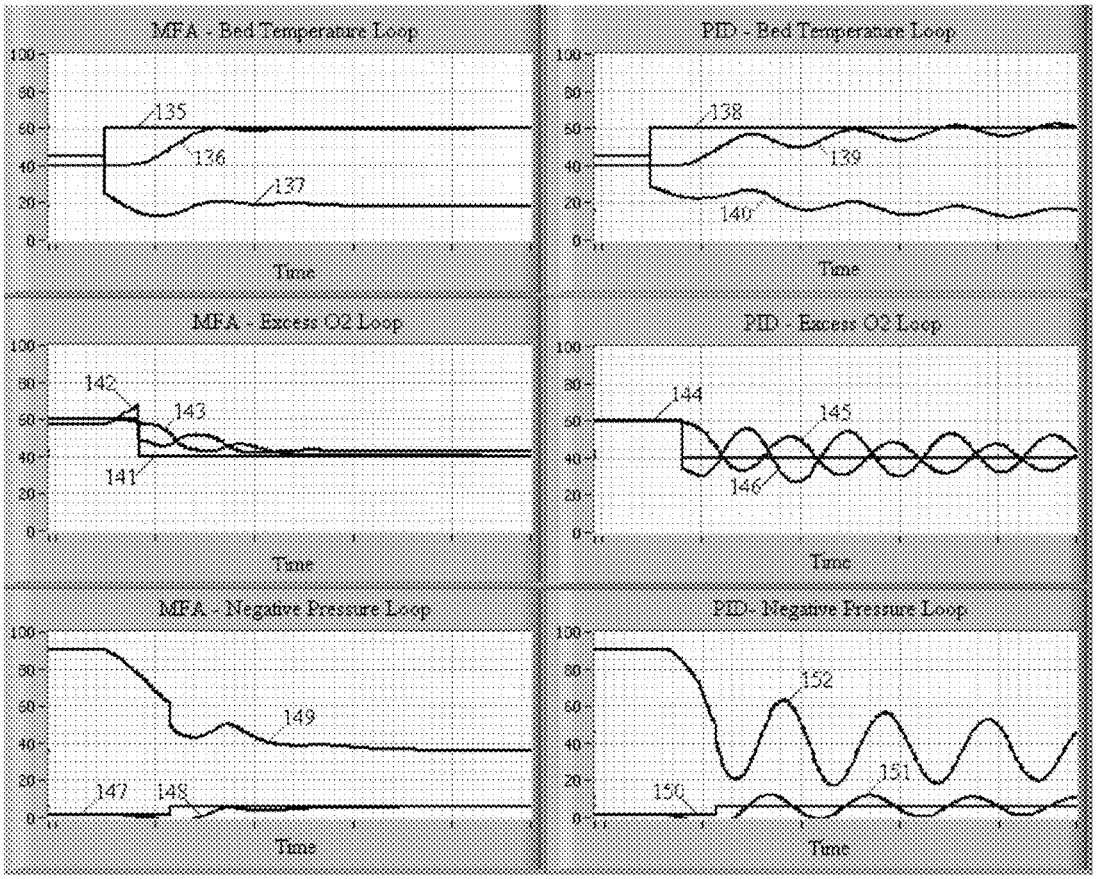
FIG. 13 is a time-amplitude diagram comparing the control performance of a 3×3 MFA control system versus a PID control system for controlling two identical CFB boiler combustion processes comprising Bed Temp, Excess O2, and Furnace Negative Pressure loops, where the setpoints for all 3 loops have step changes.

FIG. 13 is a time-amplitude diagram comparing the control performance of a 3×3 MFA control system versus a PID control system for controlling two identical CFB boiler combustion processes comprising Bed Temp, Excess O2, and Furnace Negative Pressure loops, where the setpoints for all 3 loops have step changes. In FIG. 13, curves 135, 136, 137 are SP, PV, OP of the MFA Bed Temperature loop, and curves 138, 139, 140 are SP, PV, OP of the PID Bed Temperature loop, respectively. Curves 141, 142, 143 are SP, PV, OP of the MFA Excess O2 loop, and curves 144, 145, 146 are SP, PV, OP of the PID Excess O2 loop, respectively. Curves 147, 148, 149 are SP, PV, OP of the MFA Furnace Negative Pressure loop, and curves 150, 151, 152 are SP, PV, OP of the PID Furnace Negative Pressure loop, respectively.

In this case, the Bed Temperature SP (Signals 135 and 138) is firstly stepped up from 45 to 60, the Excess O2 SP (Signals 141 and 144) is then stepped down from 60 to 40, and the Furnace Pressure SP (Signals 147 and 150) is lastly stepped up from 3 to 6. It can be seen that each setpoint change causes disturbances to all control loops. The 3×3 MFA air control system is able to deal with the disturbances and keeps the Bed Temp, Excess O2, and Furnace Negative Pressure under control. In contrast, the PID control system cannot effectively control the 3×3 process resulting in oscillations in all 3 loops.

To summarize, the control trends demonstrate outstanding control performance of the 3×3 Fuel-Air Ratio MFA Controller for Air Systems for both tracking and regulating capabilities. The compensators inside the 3×3 MFA controller can effectively decouple and reduce the interactions from the other loops of the multivariable combustion process. The control trends also demonstrate unsatisfactory control performance of the PID control system. Since PID controllers are single-loop controllers and can only treat the 3-Input-3-Output (3×3) multivariable process as three single-input-single-output (SISO) processes, it is very difficult for the PID control system to be effective and achieve good control performance. When there is a setpoint change or disturbance in the process, it will take a long time for the loops to settle down due to interactions among the loops. For instance, when the setpoint of Loop 1 is changed, the PID control action in Loop 1 will disturb Loop 2 and 3 causing their PID controllers to produce control actions, which will come back to disturb Loop 1. The multiple and bi-directional interactions can cause conflicting control actions and trigger a vicious cycle resulting in loop oscillations. Therefore, when applying PID for multivariable control, most PID controllers are significantly de-tuned to avoid potential oscillations or even unstable control. In the real world, a large percentage of multi-input-multi-output (MIMO) processes are treated as single-input-single-output (SISO) processes resulting in poor control performance, inconsistent quality, wasted materials and energy, and plant safety problems.

FIG. 14 is a time-amplitude diagram presenting the control performance of the 7×7 MFA control system described in FIG. 8 controlling a combined 3×3 PPT process of a BTG unit and 5×5 CFB combustion process including 7 control loops: Power, Steam Pressure, Steam Temperature, Bed Temperature, Excess O2, Furnace Negative Pressure, and Bed Thickness, where the setpoints of Power, Steam Pressure, and Steam Temperature are stepped up.

In FIG. 14, curves 153, 154, 155 are SP, PV, OP of the Power loop, curves 156, 157, 158 are SP, PV, OP of the Steam Pressure loop, curves 159, 160, 161 are SP, PV, OP of the Steam Temperature loop, curves 162, 163, 164 are SP, PV, OP of the Bed Temperature loop, curves 165, 166, 167 are SP, PV, OP of the Excess O2 loop, curves 168, 169, 170 are SP, PV, OP of the Furnace Negative Pressure loop, and curves 171, 172, 173 are SP, PV, OP of the Bed Thickness loop. It is seen that combustion process loops are affected by the changes in the BTG unit. However, the MFA controllers are able to make appropriate control actions to keep these loops under good control.

FIG. 15 is a time-amplitude diagram presenting the control performance of the 7×7 MFA control system described in FIG. 8 controlling a combined 3×3 PPT process of a BTG unit and 5×5 CFB combustion process including 7 control loops: Power, Steam Pressure, Steam Temperature, Bed Temperature, Excess O2, Furnace Negative Pressure, and Bed Thickness, where the setpoints of all 7 loops have step changes.

In FIG. 15, curves 174, 175, 176 are SP, PV, OP of the Power loop, curves 177, 178, 179 are SP, PV, OP of the Steam Pressure loop, curves 180, 181, 182 are SP, PV, OP of the Steam Temperature loop, curves 183, 184, 185 are SP, PV, OP of the Bed Temperature loop, curves 186, 187, 188 are SP, PV, OP of the Excess O2 loop, curves 189, 190, 191 are SP, PV, OP of the Furnace Pressure loop, and curves 192, 193, 194 are SP, PV, OP of the Bed Thickness loop. In FIG. 15, "jerky" controller outputs are shown when setpoints of several process variables change at the same time. This means the process variables have strong interactions among them and require the controllers to make prompt and "smart" actions to compensate for the interactions and disturbances.

To conclude, the 7×7 Model-Free Adaptive (MFA) control system described in this patent shows excellent control performance and robustness in dealing with setpoint changes in different variables, interactions among the process variables, disturbances caused by varying operating conditions, and other uncertainties.

In the foreseeable future, the energy needed to support our economic growth will continue to come mainly from coal, the most abundant and lowest cost resource on this planet. The performance of coal-fired power plants is highly dependent on coordinated and integrated sensing, control, and actuation technologies and products. The control systems and methods described in this patent application as well as in U.S. patent application No. 61/473,308 can be very useful for controlling advanced boilers including Once-Through Supercritical (OTSC) Boilers, Circulating Fluidized-Bed (CFB) Boilers, and Once-Through Supercritical Circulating Fluidized-Bed (OTSC CFB) Boilers in future energy plants that can deliver maximum-energy-efficiency, near-zero-emissions, fuel-flexibility, and multi-products.

The invention claimed is:

1. A system comprising a Circulating Fluidized-Bed Boiler (CFB) combustion process with 5 inputs and 5 outputs to be controlled by a multivariable Model-Free Adaptive (MFA) control system, wherein the process having 5 process inputs as manipulated variables, 5 process outputs as the process variables to be controlled, 5 main-processes $H_{11}$, $H_{22}$, $H_{33}$, $H_{44}$, $H_{55}$, and 20 sub-processes $H_{21}$, $H_{31}$, . . . , $H_{45}$ according to the following table:

| | Process Outputs - Process Variables to be Controlled | | | | |
|---|---|---|---|---|---|
| Process Inputs - Manipulated Variables | Bed Temp ($T_B$) | Excess O2 ($O_2$) | Negative Pressure ($P_N$) | Bed Thickness ($D_B$) | Firing Rate ($R_F$) |
| Primary Air ($F_P$) | $H_{11}$ | $H_{21}$ | $H_{31}$ | $H_{41}$ | $H_{51}$ |
| Secondary Air ($F_S$) | $H_{12}$ | $H_{22}$ | $H_{32}$ | $H_{42}$ | $H_{52}$ |
| Exhaust Air ($F_E$) | $H_{13}$ | $H_{23}$ | $H_{33}$ | $H_{43}$ | $H_{53}$ |
| Slag Disposal ($F_D$) | $H_{14}$ | $H_{24}$ | $H_{34}$ | $H_{44}$ | $H_{54}$ |
| Coal Feed ($F_C$). | $H_{15}$ | $H_{25}$ | $H_{35}$ | $H_{45}$ | $H_{55}$ |

2. The system of claim 1, further comprising a Power-Pressure-Temperature (PPT) process of a Boiler-Turbine-Generator (BTG) unit of a Circulating Fluidized-Bed (CFB) Boiler or a Once-Through Supercritical Circulating Fluidized-Bed (OTSC CFB) Boiler, where the Firing Rate ($R_F$) as the output of the CFB combustion process is the manipulated variable for controlling the Power of the PPT process of a BTG unit.

3. The system of claim 1, further comprising a Throttle Valve and Steam Flow sub-system, whose output is the manipulated variable for controlling the Steam Pressure of the PPT process.

4. The system of claim 1, further comprising a Water Flow sub-system, whose output is the manipulated variable for controlling the Steam Temperature of the PPT process.

5. A 3-Input-3-Output (3×3) Fuel-Air Ratio Controller comprising a 3-Input-3-Output (3×3) MFA Controller, three signal adders, three calculation blocks, one scaling block, a fuel flow signal $u_f(t)$ as an input, three setpoint signals $r_1(t)$, $r_2(t)$, $r_3(t)$, three process variables to be controlled $y_1(t)$, $y_2(t)$, $y_3(t)$, three error signals $c_1(t)$, $c_2(t)$, $c_3(t)$, and three controller output signals $u_1(t)$, $u_2(t)$, $u_3(t)$; wherein the 3×3 MFA Controller having three output signals $u_{a1}(t)$, $u_{a2}(t)$, $u_{a3}(t)$, and the control output signals of the (3×3) Fuel-Air Ratio Controller being calculated substantially of the form:

$$v_f(t)=L[u_f(t)],$$

$$u_1(t)=a_1v_f(t)+\Delta u_{a1}(t),$$

$$u_2(t)=a_2v_f(t)+\Delta u_{a2}(t),$$

$$u_3(t)=a_3v_f(t)+\Delta u_{a3}(t),$$

where $u_f(t)$ is the fuel flow signal, L(.) is a scaling function to scale the fuel flow signal $u_f(t)$ to a control signal $v_f(t)$ in the range of 0 to 100, $\Delta u_{a1}(t)$, $\Delta u_{a2}(t)$, $\Delta u_{a3}(t)$ are controller output incremental signals from the 3×3 MFA Controller, and $a_1$, $a_2$, $a_3$ are fuel-air ratio parameters.

6. A 3-Input-3-Output (3×3) Fuel-Air Ratio Controller comprising a 3-Input-3-Output (3×3) Controller, three signal adders, three calculation blocks, one scaling block, a fuel flow signal $u_f(t)$ as an input, three setpoint signals $r_1(t)$, $r_2(t)$, $r_3(t)$, three process variables to be controlled $y_1(t)$, $y_2(t)$, $y_3(t)$, three error signals $e_1(t)$, $e_2(t)$, $e_3(t)$, and three controller output signals $u_1(t)$, $u_2(t)$, $u_3(t)$; wherein the 3×3 Controller having three output signals $u_{a1}(t)$, $u_{a2}(t)$, $u_{a3}(t)$, and the control output signals of the (3×3) Fuel-Air Ratio Controller being calculated substantially of the form:

$$v_f(t)=L[u_f(t)],$$

$$u_1(t)=a_1v_f(t)+\Delta u_{a1}(t),$$

$$u_2(t)=a_2v_f(t)+\Delta u_{a2}(t),$$

$$u_3(t)=a_3v_f(t)+\Delta u_{a3}(t),$$

where $u_f(t)$ is the fuel flow signal, L(.) is a scaling function to scale the fuel flow signal $u_f(t)$ to a control signal $v_f(t)$ in the range of 0 to 100, $\Delta u_{a1}(t)$, $\Delta u_{a2}(t)$, $\Delta u_{a3}(t)$ are controller output incremental signals from the 3×3 Controller, and $a_1$, $a_2$, $a_3$ are fuel-air ratio parameters.

7. A control system, comprising:

a) a Circulating Fluidized-Bed Boiler (CFB) combustion process having process inputs comprising one or more of Primary Air, Secondary Air, Exhaust Air, Slag Disposal and Coal Feed as manipulated variables and having process outputs comprising one or more of Bed Temperature, Excess O2, Furnace Negative Pressure, Bed Thickness, and Firing Rate as the process variables to be controlled;

b) a 3-Input-3-Output (3×3) Fuel-Air Ratio Controller whose outputs manipulate the Primary Air, Secondary Air, and Exhaust Air of the CFB combustion process to control Bed Temperature, Excess O2, and Furnace Negative Pressure; and c) a Coal Feed or Fuel Flow setpoint being used as an input to the 3×3 Fuel-Air Ratio Controller.

8. The control system of claim 7, further comprising a Single-Input-Single-Output (SISO) MFA controller or a SISO controller to control the CFB Bed Thickness by manipulating the Disposal Flow.

9. The control system of claim 7, further comprising Single-Input-Single-Output (SISO) MFA control systems or SISO control systems for the Primary Air Loop, Secondary Air Loop, and Coal Feed Loop, respectively.

10. A control system, comprising:

a) a combined 5-Input-5-Output (5×5) Circulating Fluidized-Bed Boiler (CFB) combustion process and 3-Input-3-Output (3×3) Power-Pressure-Temperature (PPT) process of a Boiler-Turbine-Generator (BTG) unit, where the Firing Rate of the CFB process is an input to the PPT process;

b) a Primary Air control loop, Secondary Air control loop, and a Coal Feed control loop;

c) a Throttle Valve and Steam Flow sub-system;

d) a Water Flow sub-system; and e) a 7-Input-7-Output (7×7) Model-Free Adaptive (MFA) control system arranged to control one or more of Power, Steam Pressure, Steam Temperature, Bed Temperature, Excess O2, Furnace Negative Pressure, and Bed Thickness of the combined CFB combustion process and PPT process.

11. The control system of claim 10, where the 7×7 MFA control system comprises:

a) a 3-Input-3-Output (3×3) Fuel-Air Ratio Controller arranged to manipulate the Primary Air, Secondary Air, and Exhaust Air of the CFB combustion process to control Bed Temperature, Excess O2, and Furnace Negative Pressure;

b) a Single-Input-Single-Output (SISO) MFA controller arranged to control the CFB Bed Thickness by manipulating the Disposal Flow; and c) a 3-Input-3-Output (3×3) MFA controller arranged and cascaded with the Coal Feed Loop, Throttle Valve and Steam Flow sub-system, and Water Flow sub-system to control Power, Steam Pressure, and Steam Temperature of the PPT process.

12. A control system, comprising:

a) a combined 5-Input-5-Output (5×5) Circulating Fluidized-Bed Boiler (CFB) combustion process and 3-Input-3-Output (3×3) Power-Pressure-Temperature (PPT) process of a Boiler-Turbine-Generator (BTG) unit, where the Firing Rate of the CFB process is an input to the PPT process;

b) a Primary Air control loop, Secondary Air control loop, and a Coal Feed control loop;

c) a Throttle Valve and Steam Flow sub-system;

d) a Water Flow sub-system; and e) a 7-Input-7-Output (7×7) control system arranged to control one or more of Power, Steam Pressure, Steam Temperature, Bed Temperature, Excess O2, Furnace Negative Pressure, and Bed Thickness of the combined CFB combustion process and PPT process.

13. The control system of claim 12, where the 7×7 control system comprises:

a) a 3-Input-3-Output (3×3) Fuel-Air Ratio Controller arranged to manipulate the Primary Air, Secondary Air, and Exhaust Air of the CFB combustion process to control Bed Temperature, Excess O2, and Furnace Negative Pressure;

b) a Single-Input-Single-Output (SISO) controller arranged to control the CFB Bed Thickness by manipulating the Disposal Flow; and c) a 3-Input-3-Output (3×3) controller arranged and cascaded with the Coal Feed Loop, Throttle Valve and Steam Flow sub-system, and Water Flow sub-system to control Power, Steam Pressure, and Steam Temperature of the PPT process.

14. A Model-Free Adaptive (MFA) control system arranged to control a plurality of the process variables set forth in claim 1.

15. A Model-Free Adaptive (MFA) control system arranged to control the combined CFB combustion process and PPT process of claim 2, in which the MFA control system is configured to control a predefined selection of the process variables as critical process variables.

16. The system of claim 15, where the critical process variables include Bed Temperature, Excess O2, Furnace Negative Pressure, Bed Thickness, Power, Steam Throttle Pressure and Steam Temperature.

* * * * *